US012474085B2

(12) United States Patent
Liu

(10) Patent No.: US 12,474,085 B2
(45) Date of Patent: Nov. 18, 2025

(54) DEHUMIDIFIER

(71) Applicants: GD MIDEA AIR-CONDITIONING EQUIPMENT CO., LTD., Foshan (CN); MIDEA GROUP CO., LTD., Foshan (CN)

(72) Inventor: Fashen Liu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 330 days.

(21) Appl. No.: 18/033,692

(22) PCT Filed: Mar. 23, 2021

(86) PCT No.: PCT/CN2021/082369
§ 371 (c)(1),
(2) Date: Apr. 25, 2023

(87) PCT Pub. No.: WO2022/099968
PCT Pub. Date: May 19, 2022

(65) Prior Publication Data

US 2023/0392823 A1 Dec. 7, 2023

(30) Foreign Application Priority Data

Nov. 16, 2020 (CN) ..... 202011283764.8
Nov. 16, 2020 (CN) ..... 202022648828.1

(51) Int. Cl.
*F24F 13/22* (2006.01)

(52) U.S. Cl.
CPC ..... *F24F 13/222* (2013.01)

(58) Field of Classification Search
CPC .... F24F 13/222; F24F 13/22; F24F 2013/227; F24F 3/14; F24F 2003/144; F24F 2003/1446
See application file for complete search history.

(56) References Cited

FOREIGN PATENT DOCUMENTS

| | | | |
|---|---|---|---|
| CN | 102393029 | A | 3/2012 |
| CN | 102620364 | A | 8/2012 |
| CN | 101881501 | B | 11/2014 |
| CN | 104344513 | A | 2/2015 |
| CN | 205261877 | U | 5/2016 |
| CN | 205536212 | U | 8/2016 |
| CN | 108548235 | A | 9/2018 |
| CN | 211177376 | U | 8/2020 |

(Continued)

OTHER PUBLICATIONS

The World Intellectual Property Organization (WIPO) International Search Report and Written Opinion for PCT/CN2021/082369 Aug. 5, 2021 17 pages (including English translation).

(Continued)

*Primary Examiner* — Tavia Sullens
(74) *Attorney, Agent, or Firm* — Anova Law Group, PLLC

(57) ABSTRACT

A dehumidifier includes a water tank, a body including a dehumidification device, and a water collection mechanism below the dehumidification device and between the body and the water tank. The water collection mechanism includes a water groove and a drainage passageway communicated with the water groove and configured to guide water produced by the dehumidification device to an inner wall of the water tank.

15 Claims, 27 Drawing Sheets

(56) References Cited

FOREIGN PATENT DOCUMENTS

| | | | |
|---|---|---|---|
| CN | 211822855 | U | 10/2020 |
| CN | 211854261 | U | 11/2020 |
| CN | 112229052 | A | 1/2021 |
| CN | 212619240 | U | 2/2021 |
| CN | 213237776 | U | 5/2021 |
| CN | 213713516 | U | 7/2021 |
| JP | 2002188829 | A | 7/2002 |
| JP | 2004036921 | A | 2/2004 |
| JP | 2019095163 | A | 6/2019 |
| JP | 2020127918 | A | 8/2020 |
| KR | 20070065511 | A | 6/2007 |
| KR | 20140110654 | A | 9/2014 |

OTHER PUBLICATIONS

China National Intellectual Property Administration (CNIPA) Office Action 1 for 202011283764.8 Jun. 1, 2024 15 Pages (including translation).

The European Patent Office (EPO) Extended Search Report for EP Application No. 21890503.2 Mar. 5, 2024 10 Pages.

DEHUMIDIFIER

CROSS-REFERENCE TO RELATED APPLICATIONS

This application is a National Stage Entry under 35 U.S.C. § 371 of International Application No. PCT/CN2021/082369, filed on Mar. 23, 2021, which claims priority to Chinese Patent Application Nos. 202011283764.8 and 202022648828.1, both filed on Nov. 16, 2020, the entire contents of all of which are incorporated herein by reference.

TECHNICAL FIELD

The present disclosure relates to the technical field of air dehumidification, in particular to a dehumidifier.

BACKGROUND

Current dehumidifier is equipped with a water tank to collect dehumidification water generated in the process of dehumidification. However, when the dehumidification water droplets fall in the water tank, a certain noise is produced by the droplets hitting the bottom of the water tank due to the effect of gravity. Even if there is water inside the water tank, droplets hitting the water surface would also produce a certain noise, which has a negative impact on the comfort of the user. For example, the user's sleep quality would be affected when the dehumidifier is used in the bedroom.

SUMMARY

The main objective of the present disclosure is to provide a dehumidifier, which aims to decrease the noise produced by the droplets during the dehumidification process.

In order to achieve the above objective, the present disclosure provides a dehumidifier, including:

a water tank; and a body including a dehumidification device, a water collection mechanism below the dehumidification device is provided between the body and the water tank, the water collection mechanism is provided with a water groove and a drainage passageway communicated with the water groove, and the drainage passageway is configured to guide water produced by the dehumidification device to an inner wall of the water tank.

In some embodiments, the drainage passageway includes a water hole and a guide groove, the water hole penetrates a bottom of the water groove, the guide groove is provided under and communicated with the water hole, and an outlet of the guide groove extends to the inner wall of the water tank.

In some embodiments, the body further includes a plug mechanism movably mounted on the water groove to open or close the water hole.

In some embodiments, the plug mechanism includes a plug member in a pivot joint with the water groove; and an elastic member being elastic to press the plug member to the water hole for plugging the water hole. The plug member is provided with an unlock member and the water tank is provided with an abutment protrusion, and when the water tank is assembled with the body, the abutment protrusion is in abutment with the unlock member to raise the plug member for opening the water hole.

In some embodiments, an avoidance notch is provided on a side wall of the water groove, and the unlock member protrudes through the avoidance notch to abut the abutment protrusion.

In some embodiments, the plug member includes a pressure plate in pivot joint with the water groove, the unlock member being provided on the pressure plate; and a water plug provided on the pressure plate for opening or closing the water hole.

In some embodiments, a fixation column is provided on a bottom of the water groove and a free end of the fixation column is provided with a limit member, the plug member is provided with an avoidance hole and the fixation column passes through the avoidance hole, the elastic member is sleeved the fixation column, and one end of the elastic member is in abutment with a side of the plug member away from the water hole, and the other end of the elastic member is in abutment with the limit member.

In some embodiments, a line from the water hole to the fixation column is parallel to an axis of a pivot shaft of the plug member.

In some embodiments, the inner wall of the water tank is provided with a support member, and the outlet of the guide groove is provided above the support member.

In some embodiments, the outlet of the guide groove is provided with a guide notch at a lower wall of the guide groove.

In some embodiments, the body has a working state and an idle state, the body is provided at an upper end of the water tank when in the working state, and the body is at least partially received in the water tank when in the idle state.

In some embodiments, the water collection mechanism includes a chassis provided with the water groove and the drainage passageway; and a water pan provided above the chassis. The water pan is provided with a water sink communicated with the water groove.

In some embodiments, the water sink is provided with a first isolation rib for dividing the water sink into a first water sink and a second water sink, the first isolation rib is lower than a rim of the water sink, the water pan is further provided with a guide rib for guiding the water produced by the dehumidification device to the first water sink, the first water sink is provided with a drainage outlet and the second water sink is provided with a first drainage hole, and the first drainage hole is communicated with the water groove.

In some embodiments, a second isolation rib is provided inside the water sink for forming a third water sink, the second isolation rib is higher than the first isolation rib and lower than the rim of the water sink, the third water sink is provided with a second drainage hole, a drainage pipe communicated with the second drainage hole is provided at a side of the water pan facing the chassis, and the drainage pipe penetrates the chassis to communicate with the water tank.

In some embodiments, the body includes a partition and a compressor, the water tank and the compressor are respectively provided at two sides of the partition, the water collection mechanism includes a water pan provided above the partition, the water pan is provided with the water groove above the water tank, a side of the water groove away from the partition is provided with a drainage outlet, and the drainage outlet is provided at a lowest position of the water groove.

In some embodiments, the body includes a partition and a compressor, the water tank and the compressor are respectively provided at two sides of the partition, the water collection mechanism includes a water pan provided above the partition, the water pan is provided with the water groove above the compressor, a side of the water groove away from the partition is provided with a drainage outlet, and the drainage outlet is provided at a lowest position of the water groove.

In the technical solutions of the present disclosure, a water collection mechanism below the dehumidification device is provided between the body and the water tank. The water collection mechanism is provided with a water groove and a drainage passageway communicated with the water groove, and the drainage passageway is configured to guide water produced by the dehumidification device to an inner wall of the water tank. Therefore, the dehumidification water may flow downward along the inner wall of the water tank, which may avoid the dehumidification water from directly falling in the water tank and reduce the noise produced during the dehumidification process.

BRIEF DESCRIPTION OF THE DRAWINGS

In order to more clearly illustrate the technical solutions in the embodiments of the present disclosure or in the related art, drawings in the embodiments or in the related art will be briefly described below. Obviously, the drawings in the following description are only some embodiments of the present disclosure. Other drawings can be obtained by those skilled in the art according to the structures shown in the drawings without creative work.

Figure 1:
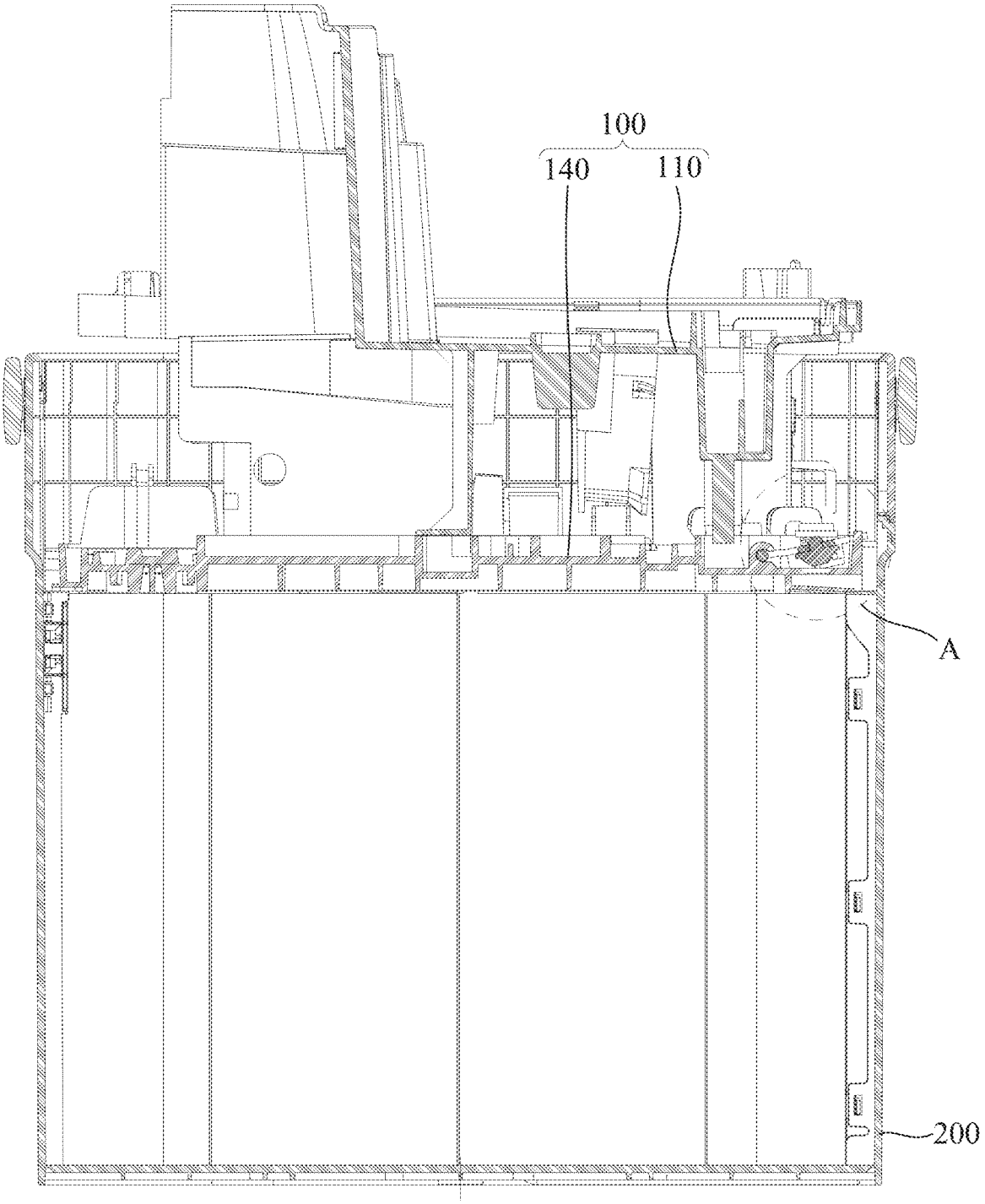
FIG. 1 is a schematic structural diagram of a water tank and a body of a dehumidifier according to some embodiments of the present disclosure.
Figure 2:
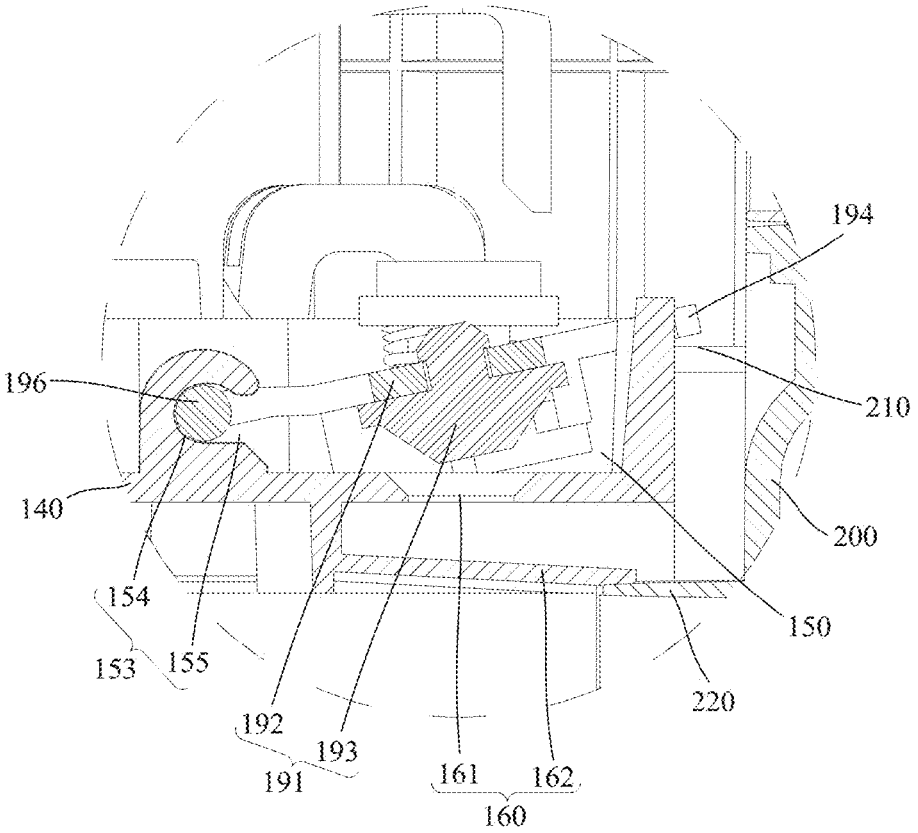
FIG. 2 is an enlarged view at portion A in FIG. 1.
Figure 3:
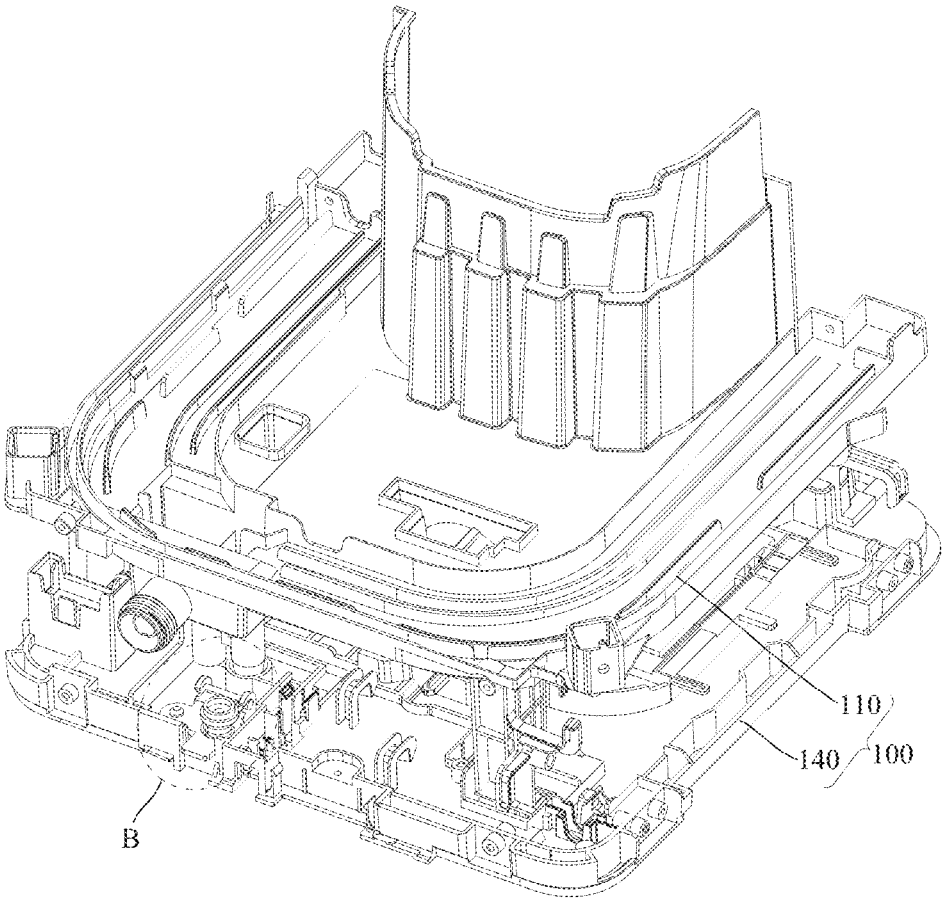
FIG. 3 is a schematic structural diagram of a water pan and a chassis in FIG. 1.
Figure 4:
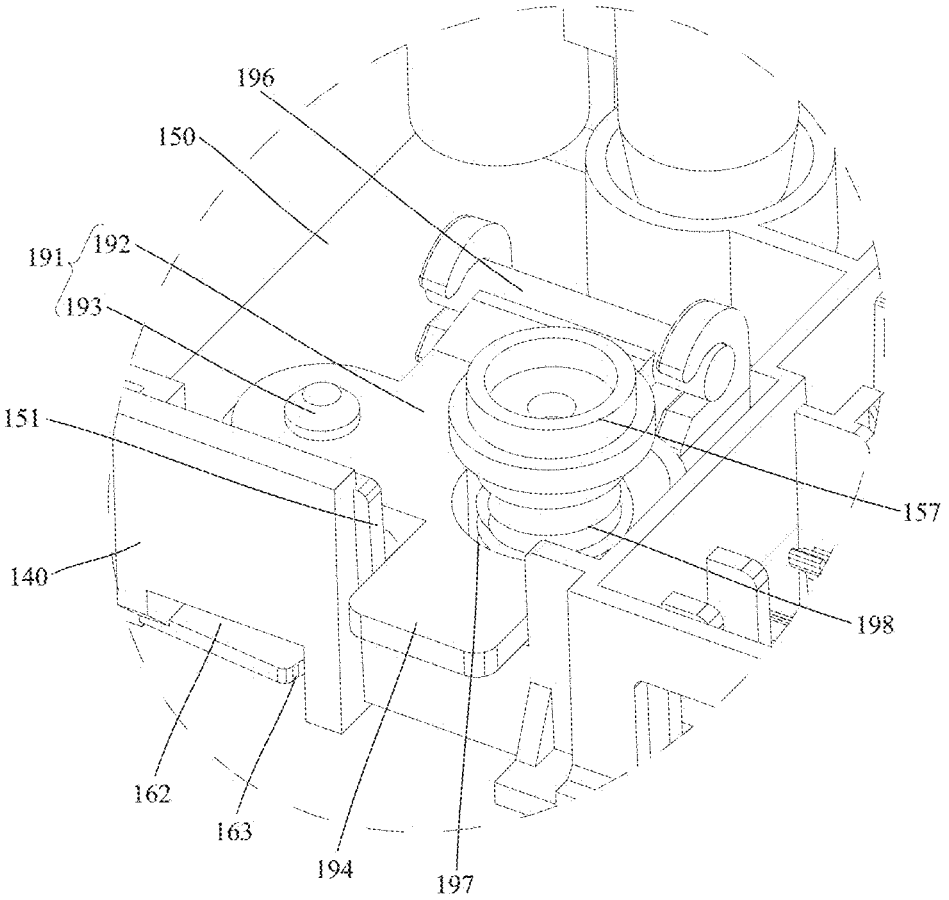
FIG. 4 is an enlarged view at portion B in FIG. 3.
Figure 5:
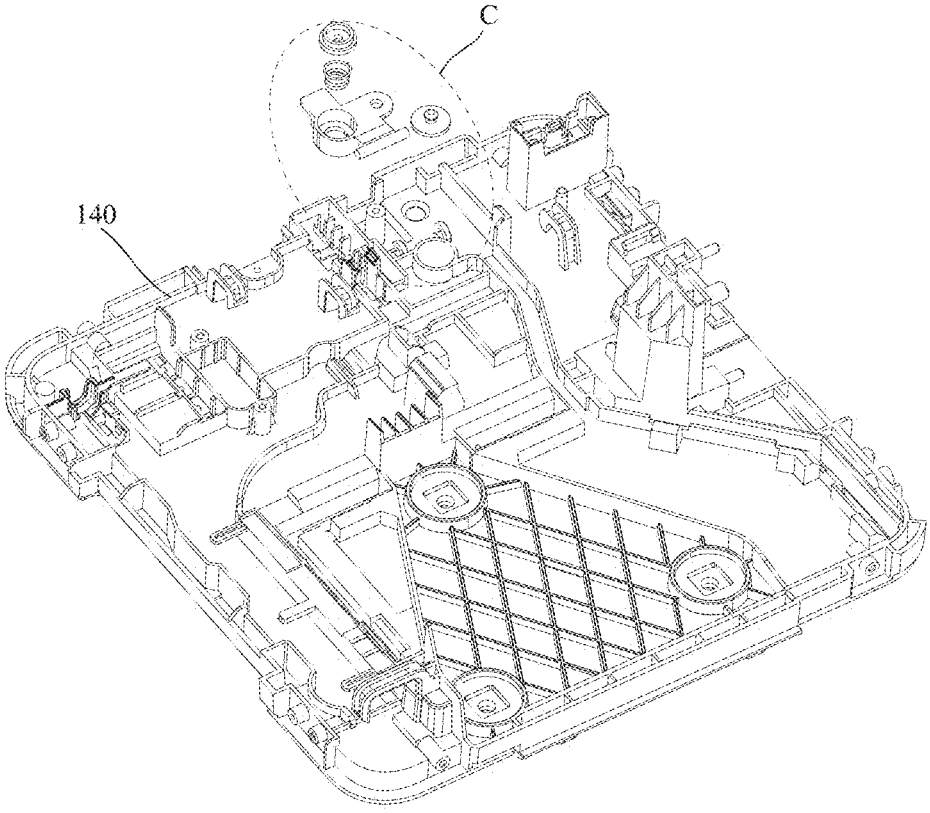
FIG. 5 is a schematic exploded view of the water pan and the chassis in FIG. 3.
Figure 6:
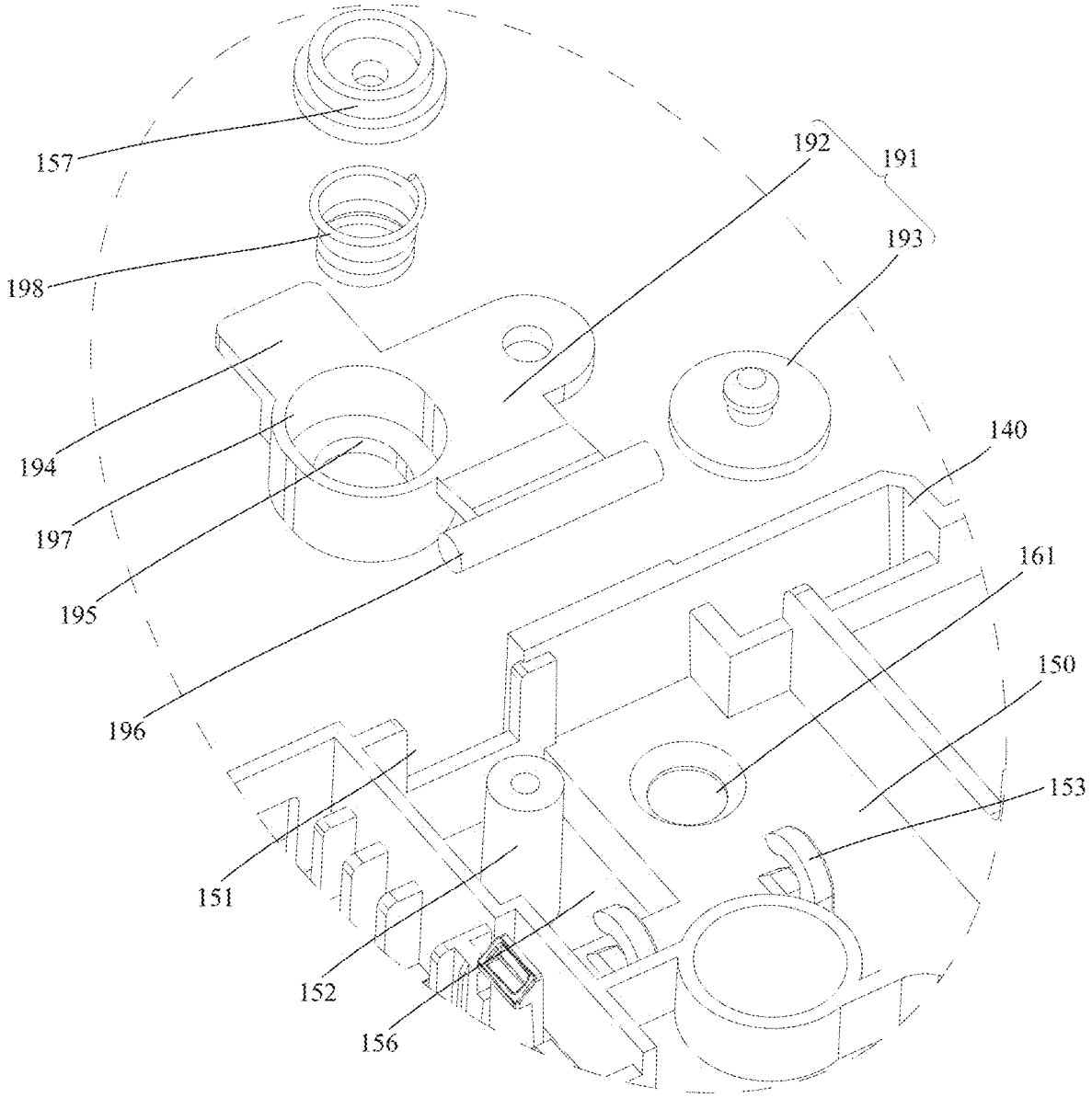
FIG. 6 is an enlarged view at portion C in FIG. 5.

The implementation, functional characteristics and advantages of the present disclosure will be further described with reference to the attached drawings in combination with embodiments.

DETAILED DESCRIPTION OF THE EMBODIMENTS

The technical solutions of embodiments of the present disclosure will be clearly and completely described with reference to the drawings of the present disclosure. Obviously, the described embodiments are only some rather than all of the embodiments of the present disclosure. Based on the embodiments of the present disclosure, all other embodiments obtained by those skilled in the art without creative efforts shall fall within the scope of the present disclosure.

It should be noted that all directional indicators (such as up, down, left, right, front, rear, etc.) in the embodiments of the present disclosure are only used to explain the relative positional relationship, movement situation, etc. among components in a specific attitude (as shown in the drawings). If the specific attitude changes, the directional indication also changes accordingly.

In addition, the descriptions related to "first", "second" and the like in the present disclosure are merely for descriptive purposes, and should not be understood as indicating or implying their relative importance or implicitly indicating the number of technical features indicated. Therefore, the features defined by "first" and "second" may explicitly or implicitly include at least one such feature. Besides, the various embodiments can be combined with each other, but the combination must be based on what can be achieved by those skilled in the art. When the combination of the embodiments is contradictory or cannot be achieved, it should be considered that such combination does not exist, or is not within the scope of the present disclosure.

The present disclosure provides a dehumidifier.

In some embodiments of the present disclosure, as shown in FIG. 1 to FIG. 6, the dehumidifier includes a water tank 200 and a body 100. The body 100 includes a dehumidification device. A water collection mechanism below the dehumidification device is provided between the body 100 and the water tank 200. The water collection mechanism is provided with a water groove 150 and a drainage passageway 160 communicated with the water groove 150, and the drainage passageway 160 is configured to guide water produced by the dehumidification device to an inner wall of the water tank 200.

In some embodiments, the body 100 includes the shell, and the dehumidification device and the water collection mechanism are provided inside the shell. When the dehumidifier is in the working state, the dehumidification water produced by the dehumidification device may fall in the water groove 150, and flow to the inner side wall of the water tank 200 through the drainage passageway 160. In some embodiments, the dehumidification device includes an evaporator and a condenser. Firstly, the water vapor in the air is condensed into water droplets by the evaporator to remove the water vapor in the air, and then after the water vapor being removed in the air, the air is heated and dried by the condenser, in order to make the blowing air back to room temperature. In other embodiments, the dehumidification device may also adopt other dehumidification methods, such as absorbing.

In the technical solution of the present disclosure, a water collection mechanism is provided below the dehumidification device and between the body 100 and the water tank 200, the water collection mechanism is provided with a water groove 150 and a drainage passageway 160 communicated with the water groove 150, and the drainage passageway 160 is configured to guide water produced by the dehumidification device to an inner wall of the water tank 200. Therefore, the dehumidification water may flow downward along the inner wall of the water tank 200, which may prevent the dehumidification water from directly falling in the water tank 200 and reduce the noise produced during the dehumidification process.

In some embodiments, the drainage passageway 160 includes a water hole 161 and a guide groove 162. The water hole 161 penetrates a bottom of the water groove 150. The guide groove 162 is provided under the water hole 161 and communicated with the water hole 161, and an outlet of the guide groove 162 extends to the inner wall of the water tank 200. In some embodiments, the water tank 200 has an opening for dehumidification water to flow into the water tank 200, the bottom wall of the water tank 200 is opposite to the opening, and the inner side wall of the water tank 200 is provided between the bottom wall and the opening. Usually, the opening faces upward when the dehumidifier is working, that is to say, the inner side wall of the water tank 200 extends in an upward and downward direction. The water hole 161 penetrates through the upper wall of the guide groove 162, and the guide groove 162 extends from the water hole 161 towards the inner wall of the water tank 200 along the lateral direction (horizontal direction). Therefore, the dehumidification water is better guided to the inner wall of the water tank 200. In addition, the structure of the guide groove 162 is simple and easy to produce. In other embodiments, the water hole 161 may also be provided on the side wall of the water groove 150, and the guide groove 162 may also be provided beside the water groove 150.

In some embodiments, the body 100 includes a plug mechanism movably mounted on the water groove 150 to open or close the water hole 161. That is to say, the plug mechanism may move relative to the water hole 161. When it is not needed to drain water from the drainage passageway 160, for example, when the body 100 and water tank 200 are disassembled, the plug mechanism may plug the water hole 161 to prevent the dehumidification water from dripping on the floor or inside the body 100. When the dehumidification water is needed to be discharged to the water tank 200, the plug mechanism may make the water hole 161 open to ensure normal drainage of the body 100. In other embodiments, it is also possible not to provide the plug mechanism.

In some embodiments, the plug mechanism includes a plug member 191 and an elastic member 198. The plug member 191 is movably mounted on the water groove 150, for example the plug member 191 is in a pivot joint with the water groove 150. The elastic member 198 is elastic to press the plug member 191 to the water hole 161 for plugging the water hole 161. The plug member 191 is provided with an unlock member 194 and the water tank 200 is provided with an abutment protrusion 210, and when the water tank 200 is assembled with the body 100, the abutment protrusion 210 is in abutment with the unlock member 194 to raise the plug member 191 for opening the water hole 161. In some embodiments, the plug member 191 is provided above the water hole 161 and the plug member 191 is capable of moving in an up and down direction relative to the water hole 161 to open or close the water hole 161. During the process of opening or closing the water hole 161 by the plug member 191, the elastic member 198 always has an elastic force that presses the plug member 191 against the water hole 161.

When the water tank 200 is assembled with the body 100, in other words, when the water tank 200 and the body 100 are installed in place, and the water tank 200 can receive water normally. In this case, the abutment protrusion 210 provided on the water tank 200 is provided below the unlock member 194, and the abutment protrusion 210 may overcome the elasticity of the elastic member 198 to lift the unlock member 194 up, such that the plug member 191 can open the water hole 161. When the body 100 and the water tank 200 are separated, the unlock member 194 is not restricted by the abutment protrusion 210. The plug member 191 would move to the plugging position to plug the water hole 161 under the effect of the elastic member 198. In this case, when the body 100 and the water tank 200 are separated, the plug member 191 may automatically plug the water hole 161, and when the body 100 is assembled with the water tank 200, the plug member 191 can automatically open the water hole 161, which avoids the condition that the user needs to manually open or close the water hole 161 and greatly improves convenience for the use. In addition, the structure is simple and conducive to reducing costs. In other embodiments, the plug mechanism can also include a plug member 191 and a motor. The motor can be used to drive the plug member 191 to open or close the water hole 161. In addition, the plug member 191 can also be slidably provided on the bottom wall of the water groove 150 to open or plug the water hole 161. In addition, the bottom wall of the water groove 150 can also be provided with a guide pillar, such that the plug member 191 is slidably mounted on the guide pillar, thereby moving in the up and down direction to open or plug the water hole 161.

In some embodiments, an avoidance notch 151 is provided on a side wall of the water groove 150, and the unlock member 194 protrudes from the avoidance notch 151 to abut with the abutment protrusion 210. In some embodiments, the avoidance notch 151 is higher than the bottom wall of the water groove 150 to ensure that the unlock member 194 may protrude from the avoidance notch 151 and prevent the dehumidification water in the water groove 150 from overflowing from the avoidance notch 151. With such a configuration, the unlocking piece is close to the side wall of the water tank 200, such that the abutment between the unlock member 194 and the abutment protrusion 210 is easier and there is no need for the abutment protrusion 210 to protrude too far inside the water tank 200 to abut with the unlock member 194, thereby reducing the size of the abutment protrusion 210 and improving the structural strength of the abutment protrusion 210. In other embodiments, an avoidance open may be provided on the bottom of the water groove 150 for the abutment protrusion 210 to protrude inside and abut the unlock member 194.

In some embodiments, the plug member 191 includes a pressure plate 192 and a water plug 193 provided on the pressure plate 192. The pressure plate 192 is in pivot joint with the water groove 150 and the unlock member 194 is provided on the pressure plate 192. The water plug 193 is configured to open or close the water hole 161. In some embodiments, when the pressure plate 192 is pressed against the water hole 161, at least part of the water plug 193 extends into the water hole 161, such that the contact area between the water plug 193 and the wall of the water hole 161 becomes larger, and the sealing effect is improved. The water plug 193 may be made of some elastic materials, such as silica gel or rubber, thereby better sealing the water hole 161 by the water plug 193. In addition, in other embodiments, the water plug 193 may not be provided, and the pressure plate 192 may cover the water hole 161 to plug the water hole 161.

In some embodiments, the water plug 193 is detachably connected to the pressure plate 192, such that it is easy to replace the water plug 193 after the airtightness of the water plug 193 reduces due to aging or other reasons. The water plug 193 and the pressing plate can be clamped or connected by screws. In other embodiments, the water plug 193 and the pressing plate may also be in a non-detachable connection.

In some embodiments, the water plug 193 is tapered, that is to say, the diameter of the water plug 193 gradually decreases toward the water hole 161, and the diameter of the water hole 161 gradually decreases in the direction away from the water groove 150. The water hole 161 is in an inverted cone shape, such that the tightness of engagement between the water plug 193 and the water hole 161 is improved, thereby improving the plugging effect. In other embodiments, the water hole 161 may also be a cylindrical hole, or the water plug 193 may be cylindrical.

In some embodiments, a fixation column 152 is provided on a bottom of the water groove 150 and a free end of the fixation column 152 is provided with a limit member 157, and the plug member 191 (pressure plate 192) is provided with an avoidance hole 195 and the fixation column 152 passes through the avoidance hole 195. The elastic member 198 is sleeved outside the fixation column 152, one end of the elastic member 198 is in abutment with a side of the plug member 191 away from the water hole 161, and the other end of the elastic member 198 is in abutment with the limit member 157. In some embodiments, the elastic member 198 is a compression spring, and the elastic member 198 is in a compressed state during the opening and closing process of the water hole 161 by the plug member 191. The diameter of the avoidance hole 195 is greater than the diameter of the fixation column 152, and the fixation column 152 does not interfere with the movement of the plug member 191. The diameter of the compression spring is greater than the diameter of the avoidance hole 195 to prevent the compression spring from passing through the avoidance hole 195. With such a simple structure, the elastic member 198 can be limited by the limit member 157 and the fixation column 152, thereby to ensure the reliability of the plug mechanism. In other embodiments, the elastic member 198 may also be a rubber pad or others. In addition, the elastic member 198 can also be a tension spring, one end of the tension spring is connected to the bottom wall of the water groove 150, and the other end of the tension spring is connected to the plug member 191. During the process of opening and plugging the water hole 161 by the plug member 191, the tension spring is always in tension.

In some embodiments, the bottom wall of the water groove 150 is provided with a pivot joint portion 153, and the pivot joint portion 153 is provided with a pivot joint hole 154 and a bayonet 155 communicated with the pivot joint hole 154. The bayonet 155 is provided on a side of the pivot joint portion 153, the pivot shaft 196 of the plug member 191 is snapped into the pivot joint hole 154 through the bayonet 155. That is to say, the size of the bayonet 155 is smaller than the diameter of the pivot shaft 196 of the plug member 191, such that the pivot shaft 196 of the plug member 191 can be snapped into the pivot joint hole 154 conveniently, and the plug member 191 can also be better restricted to avoid the pivot shaft 196 of the plug member 191 from separating with the pivot joint portion 153. In other embodiments, the bayonet 155 may not be provided, and the pivot shaft 196 of the plug member 191 can be inserted into the pivot joint hole 154 from the axial direction.

In some embodiments, the surface of the plug member 191 (pressure plate 192) away from the bottom wall of the water groove 150 is provided with a first receiving groove 197, and the avoidance hole 195 is provided on the bottom wall of the first receiving groove 197. The elastic member 198 is at least partially received in the first receiving groove 197 and abuts against the bottom wall of the first receiving groove 197. In this way, the elastic member 198 and the plug member 191 have overlapping parts in the height direction of the fixation column 152, which is beneficial to reduce the size of the plug mechanism in the height direction of the fixation column 152, and improves the structural compactness of the plug mechanism. In some embodiments, the bottom wall of the water groove 150 is provided with a second receiving groove 156, and the fixation column 152 is provided on the bottom wall of the second receiving groove 156. The side of the plug member 191 facing the bottom wall of the water groove 150 is correspondingly provided with a protrusion part and the protrusion part can extend into the second receiving groove 156, such that the space of the bottom wall of the water groove 150 can be utilized to improve the structural compactness of the plug mechanism. In other embodiments, the first receiving groove 197 may not be provided, and the second receiving groove 156 may also not be provided.

In some embodiments, a line from the water hole 161 to the fixation column 152 is parallel to a pivot shaft 196 of the plug member 191. The connection line between the water hole 161 and the fixation column 152 is parallel to the pivot shaft 196 of the plug member 191, that is to say, the connection line between the avoidance hole 195 and the water plug 193 is parallel to the pivot shaft 196 of the pressure plate 192. Compared with the distribution way that the line between the water hole 161 and the fixation column 152 is perpendicular to the pivot shaft 196 of the plug member 191 (the pivot shaft 196 of the plug member 191, the water hole 161 and the fixation column 152 is distributed along a line), the above mentioned distribution way may reduce the size of the plug member 191 in the direction perpendicular to the pivot shaft 196, such that the structure of the plug member 191 is more compact. In other embodiments, the distribution direction from the water hole 161 to the fixation column 152 may be perpendicular to the pivot shaft 196 of the plug member 191.

In some embodiments, the inner wall of the water tank 200 is provided with a support member 220, and the outlet of the guide groove 162 is provided above the support member 220. The support member 220 is a protruding structure protruding from the inner wall of the water tank 200. The outlet of the guide groove 162 is connected to the upper side of the support member 220, such that the dehumidification water flowing out of the water outlet of the guide groove 162 may flow to the support member 220 at first, and then flow downward along the inner wall of the water tank 200 from the support member 220, thereby further reducing the possibility that the dehumidification water flowing from the outlet of the guide groove 162 drips toward the bottom of the water tank 200. In other embodiments, the support member 220 may not be provided, but a groove is provided on the inner wall of the water tank 200, such that the dehumidification water may flow out from the outlet of the guide groove 162 to the groove, and then flow downward from the groove along the inner wall of the water tank 200.

In some embodiments, the outlet of the guide groove 162 is provided with a guide notch 163, and the guide notch 163 is located at a lower wall of the guide groove 162. When the dehumidification water flows to the edge of the outlet of the guide groove 162, the guide notch 163 may destroy the surface tension of the water, such that the water can flow out from the edge of the outlet of the guide groove 162 more easily, thereby improving the drainage effect.

Figure 7:
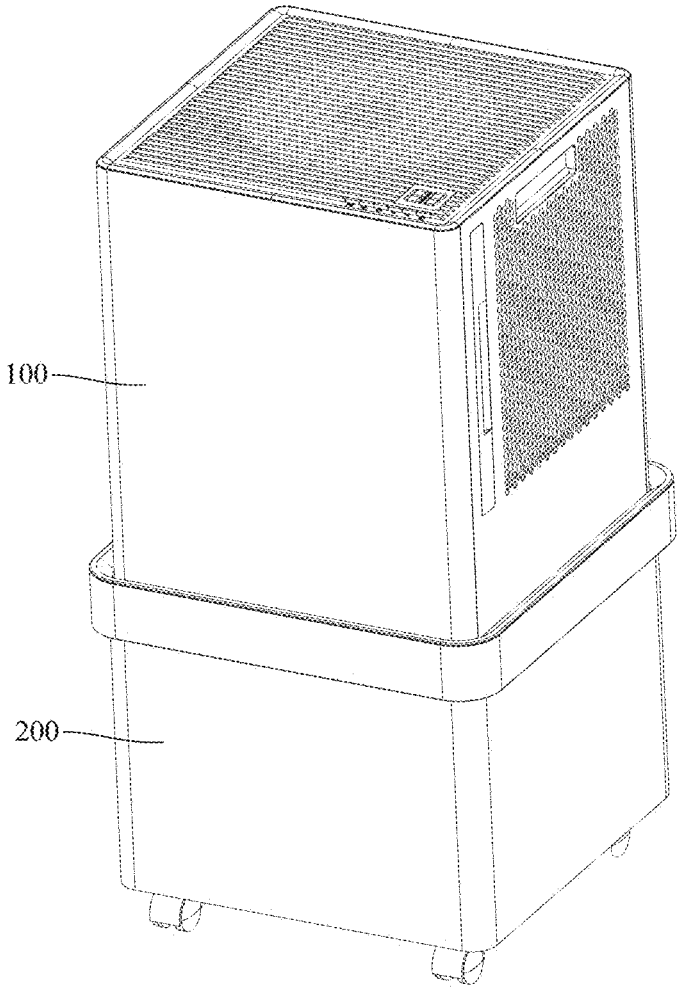
FIG. 7 is a schematic structural diagram of the body and the water tank in FIG. 1 when the body is in a working state.
Figure 8:
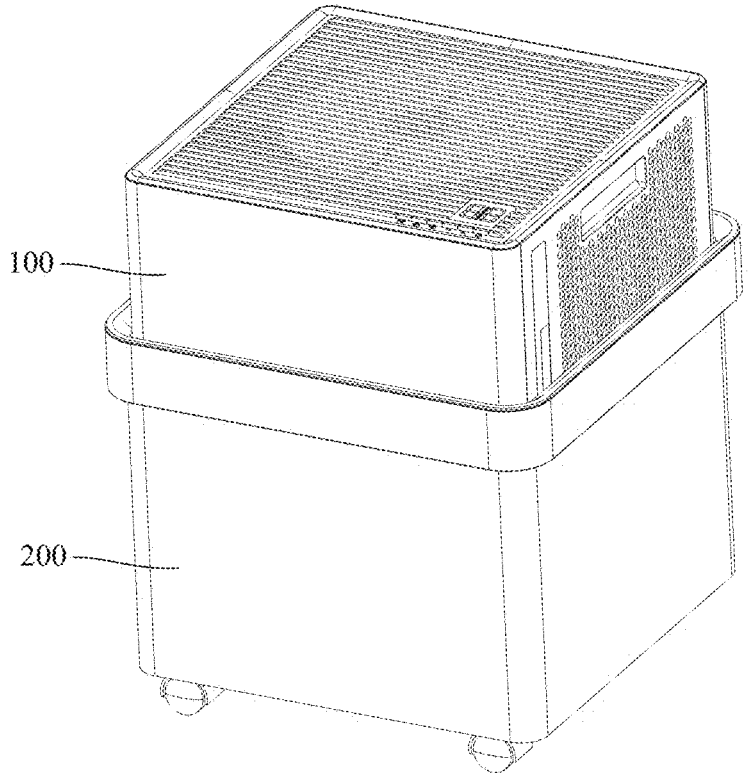
FIG. 8 is a schematic structural diagram of the water tank in FIG. 7 when the body is in an idle state.
Figure 9:
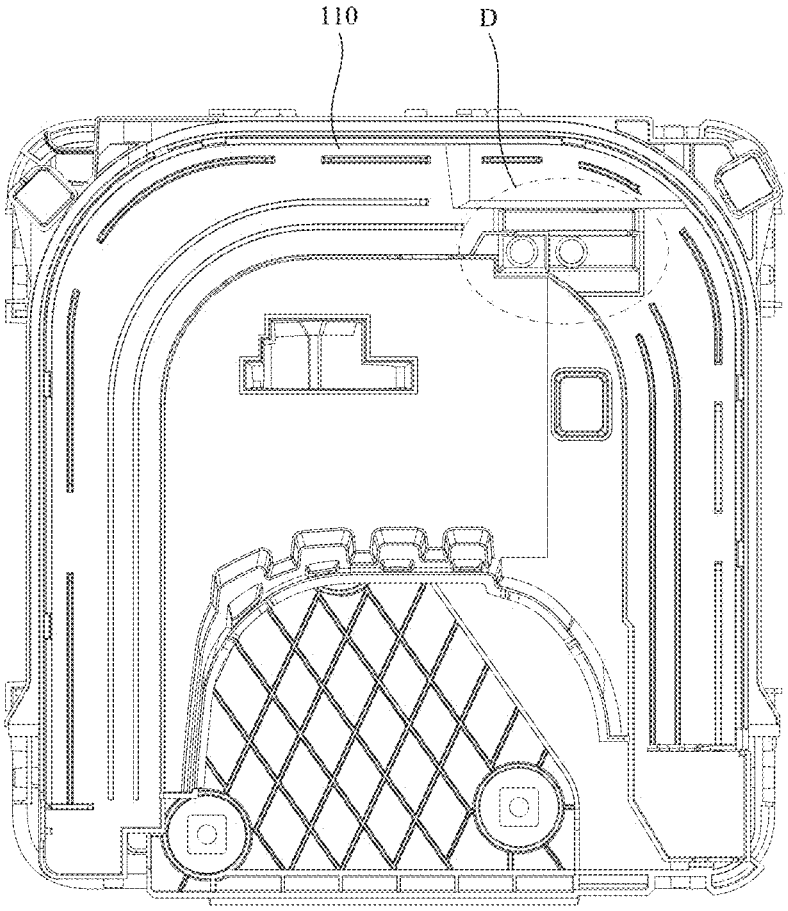
FIG. 9 is a schematic structural diagram of the water pan in FIG. 1.
Figure 10:
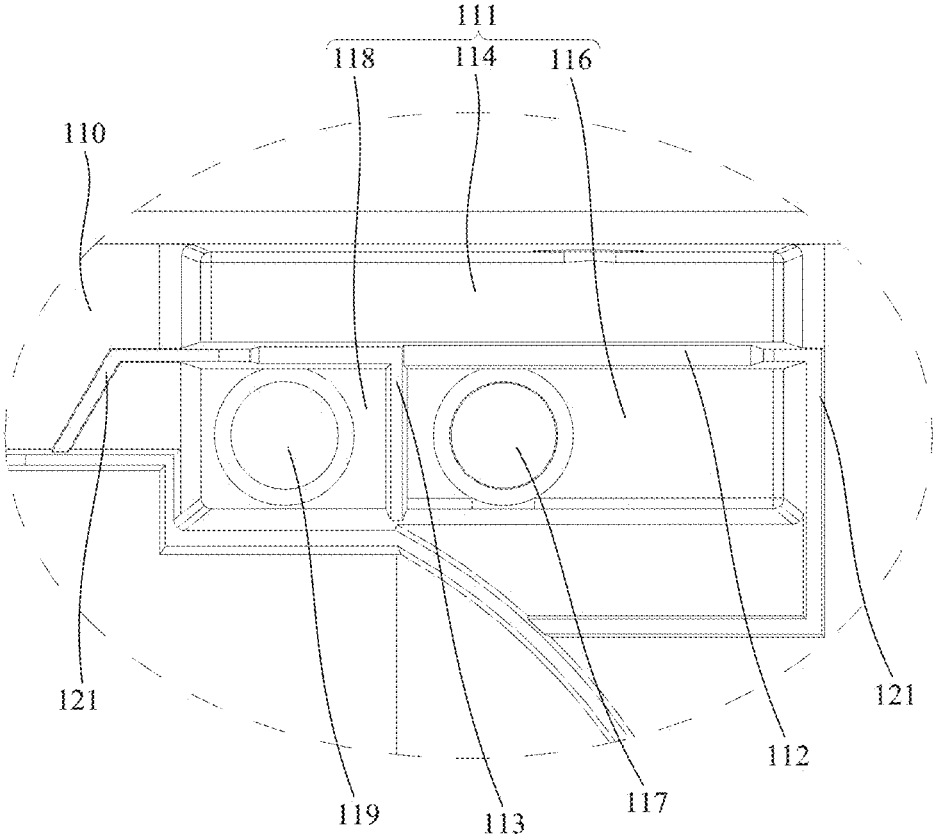
FIG. 10 is an enlarged view at portion D in FIG. 9.
Figure 11:
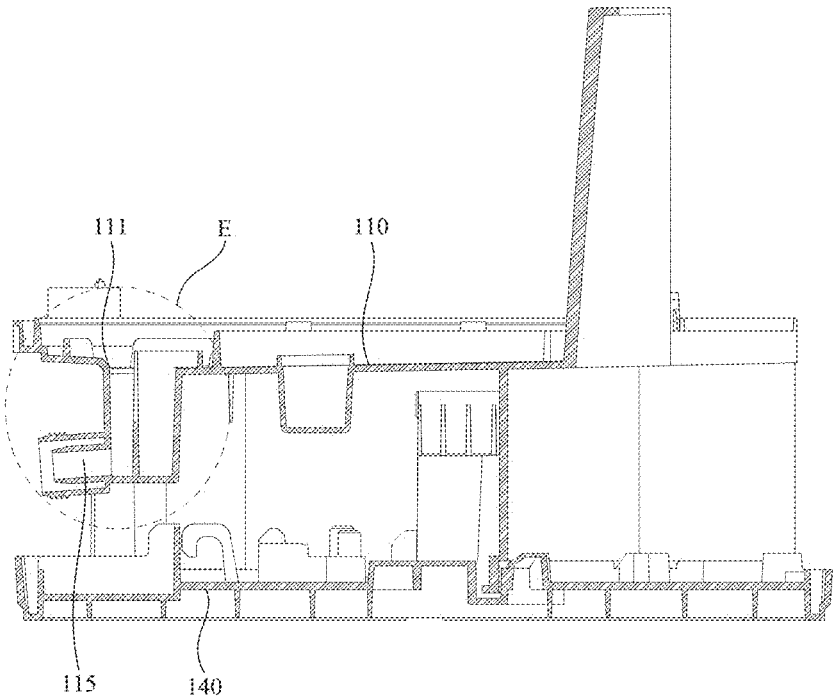
FIG. 11 is a schematic cross-sectional view of the water pan and the chassis in FIG. 9.
Figure 12:
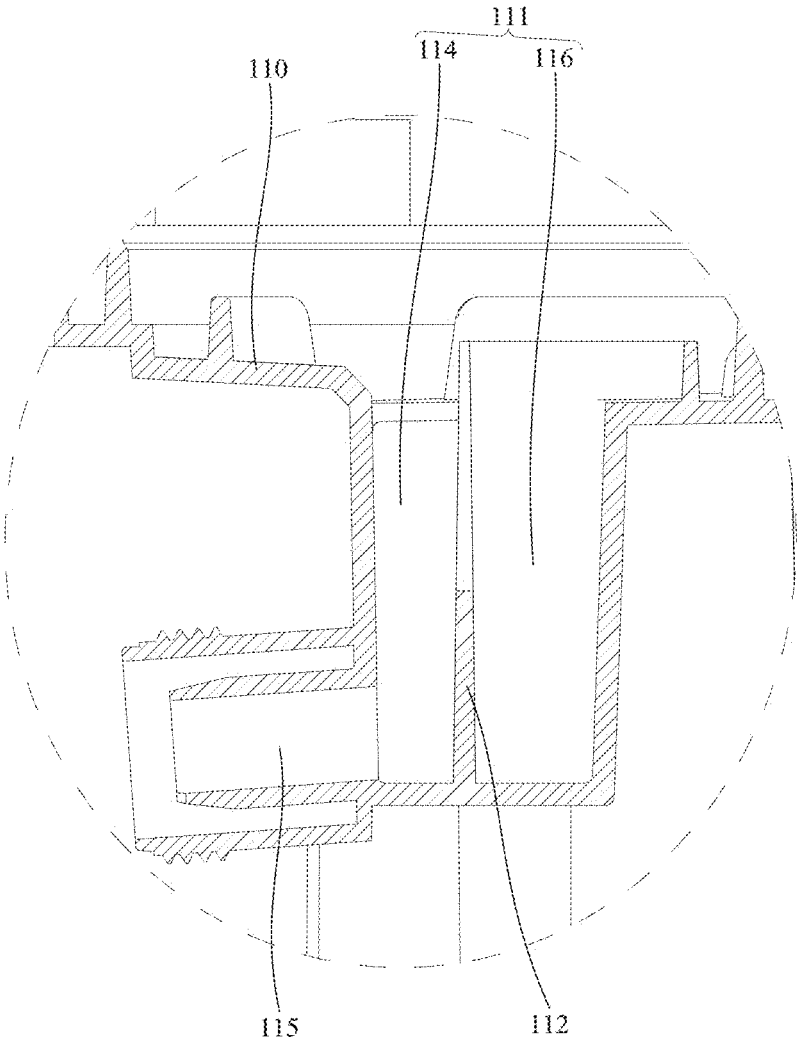
FIG. 12 is an enlarged view at portion E in FIG. 11.
Figure 13:
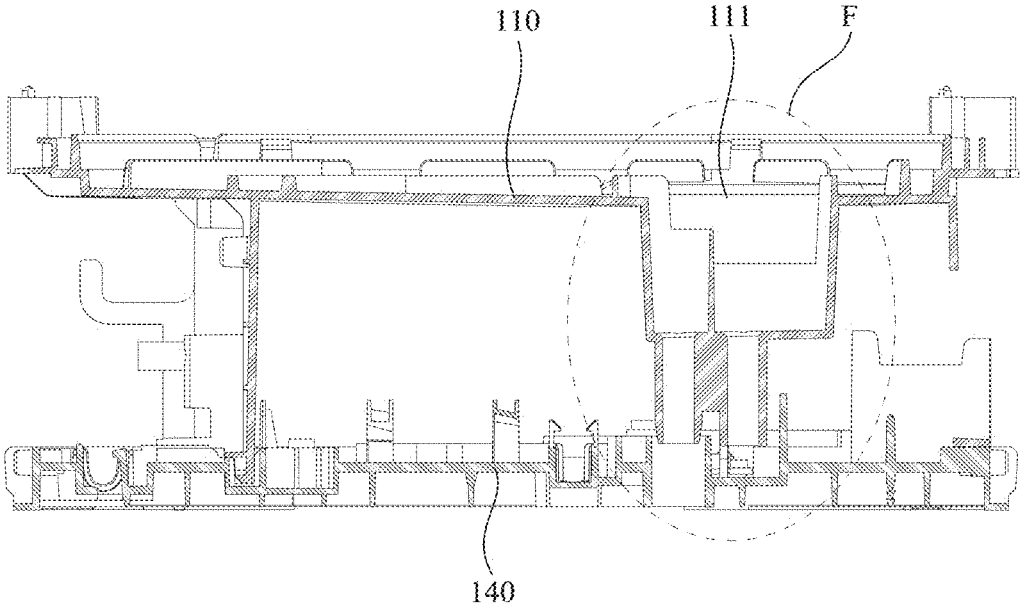
FIG. 13 is another schematic cross-sectional view of the water pan and the chassis in FIG. 9.
Figure 14:
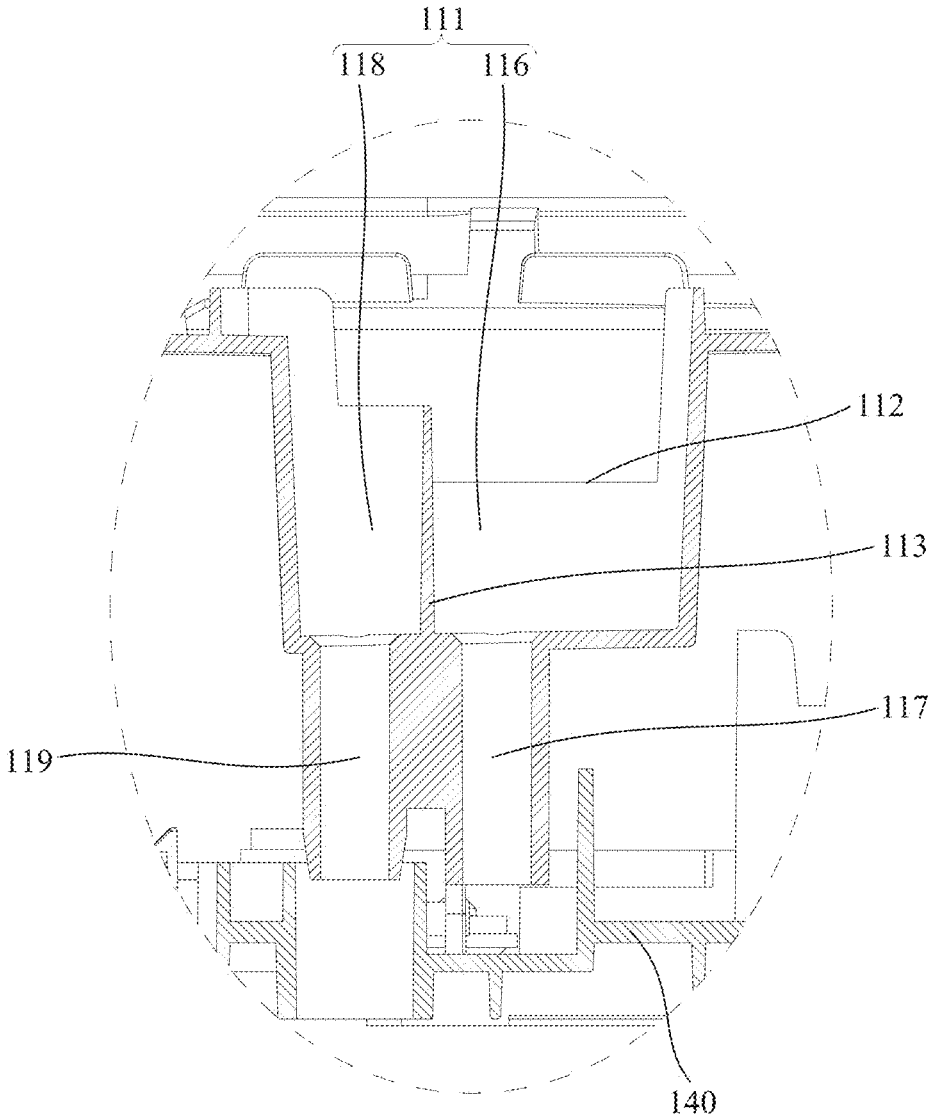
FIG. 14 is an enlarged view at portion F in FIG. 13.
Figure 15:
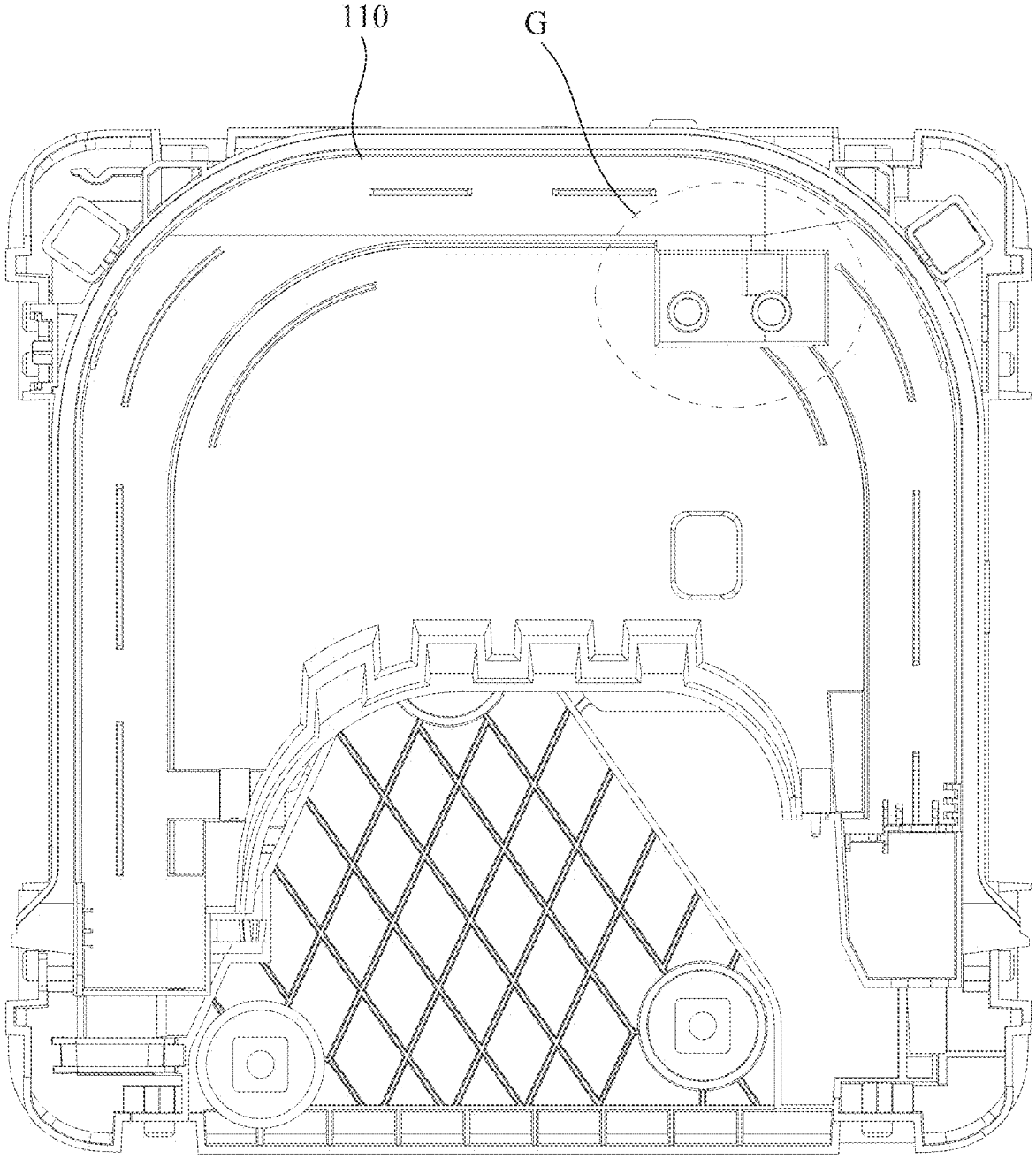
FIG. 15 is a schematic structural diagram of a water pan of a dehumidifier according to some embodiments of the present disclosure.
Figure 16:
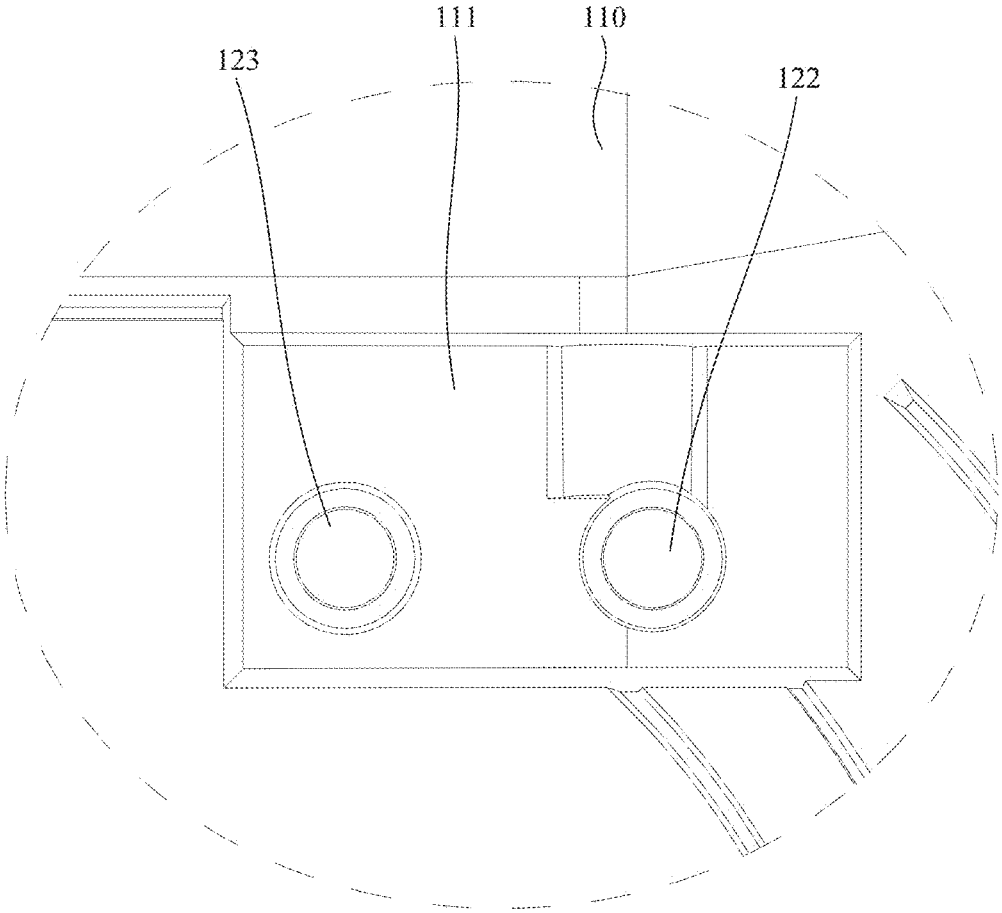
FIG. 16 is an enlarged view at portion Gin FIG. 15.
Figure 17:
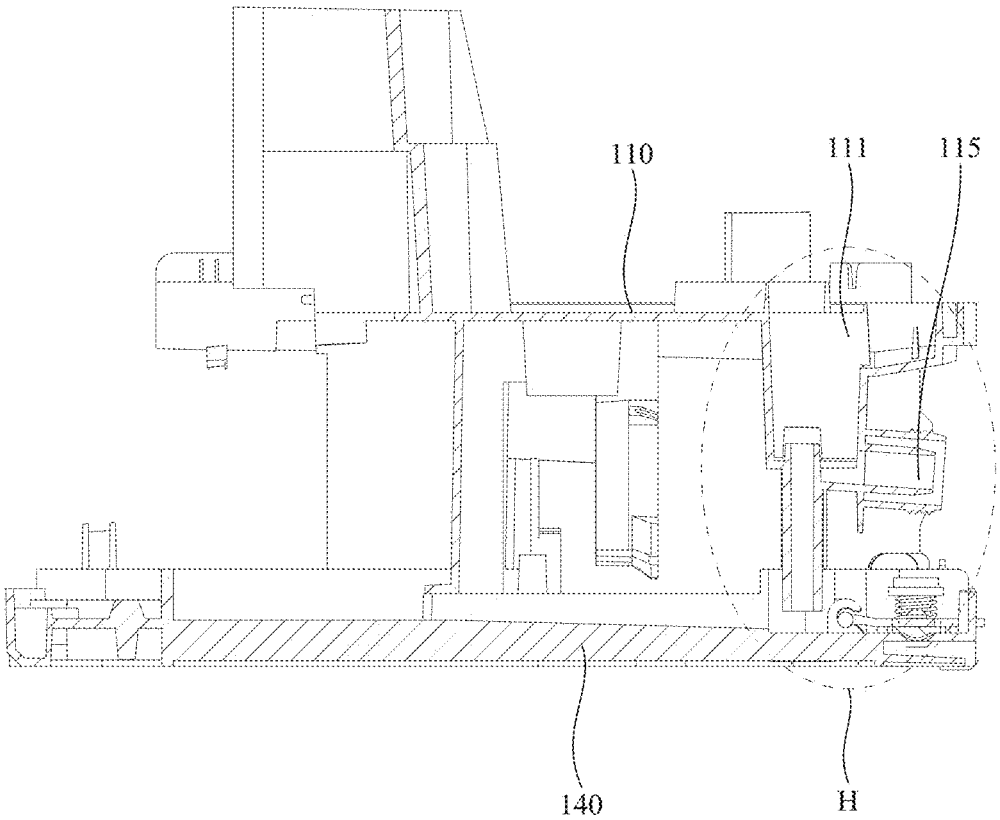
FIG. 17 is a schematic cross-sectional view of the water pan and a chassis in FIG. 15.
Figure 18:
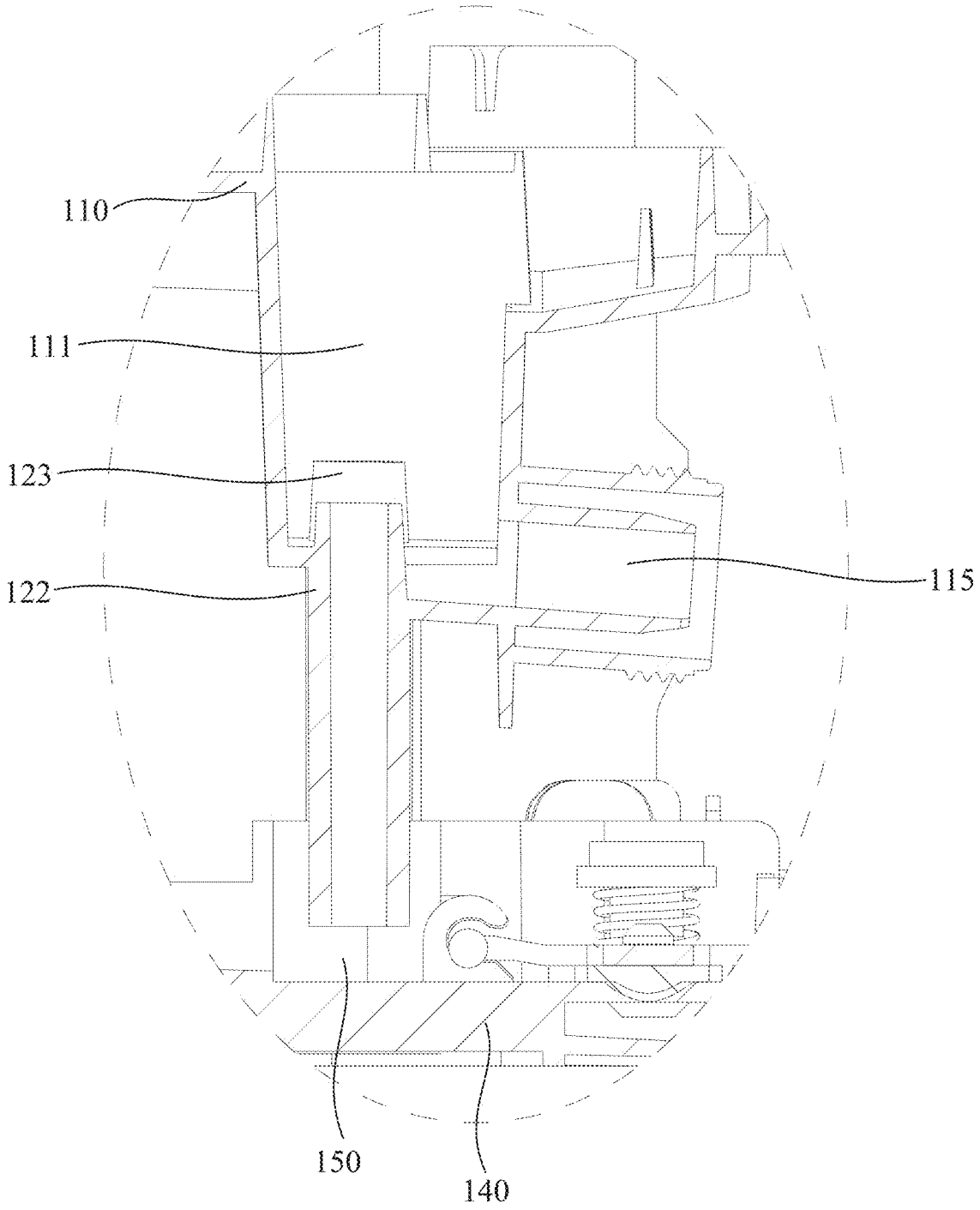
FIG. 18 is an enlarged view at portion H in FIG. 17.
Figure 19:
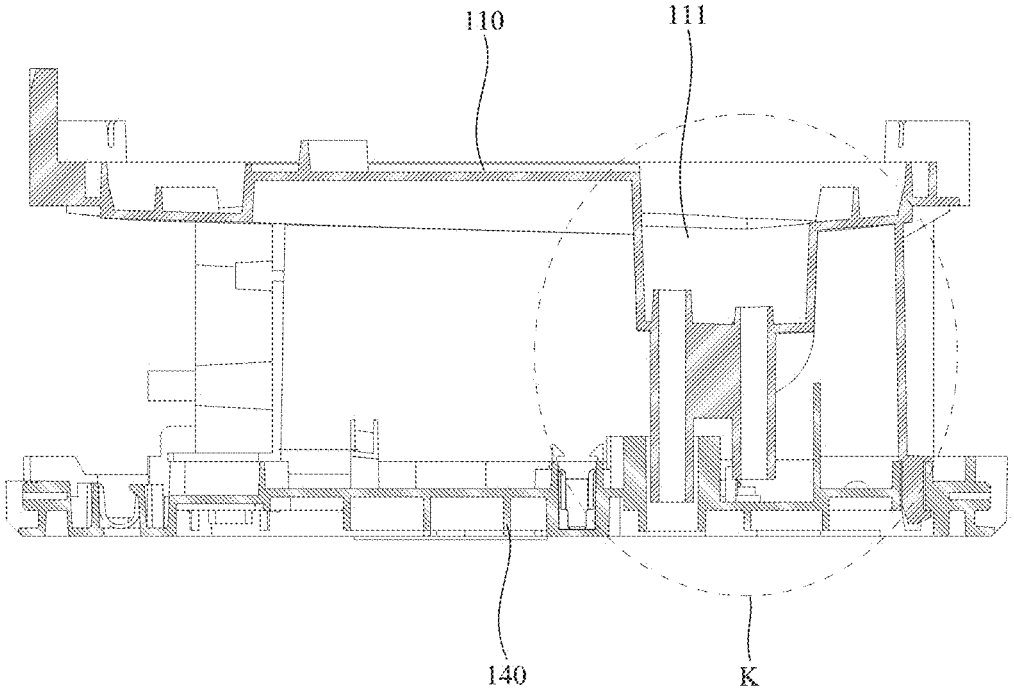
FIG. 19 is another schematic cross-sectional view of the water pan and the chassis in FIG. 15.
Figure 20:
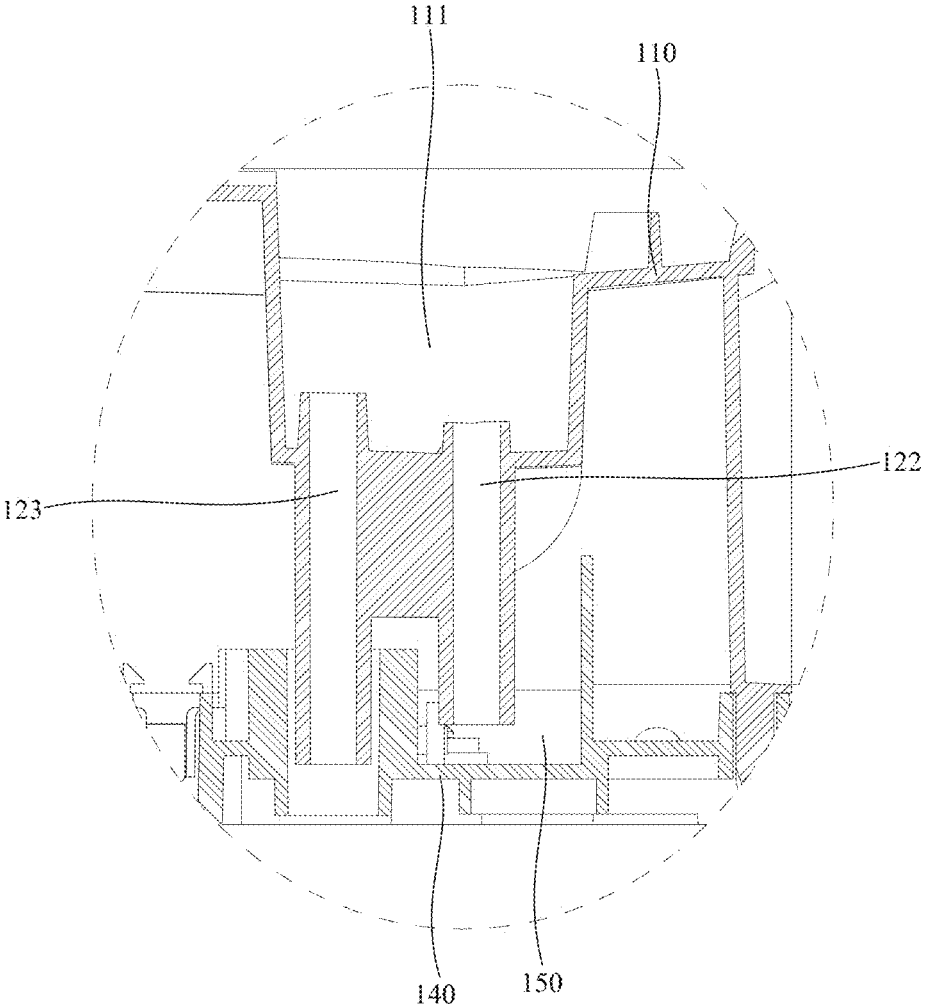
FIG. 20 is an enlarged view at portion K in FIG. 19.
Figure 21:
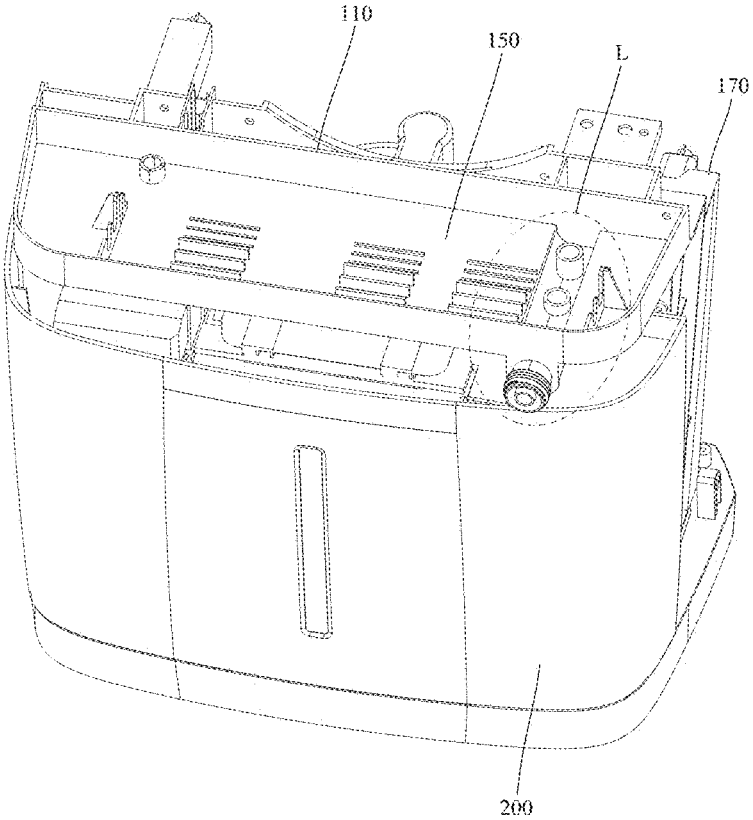
FIG. 21 is a schematic structural diagram of a water pan, a water tank and a partition of a humidifier according to some embodiments of the present disclosure.
Figure 22:
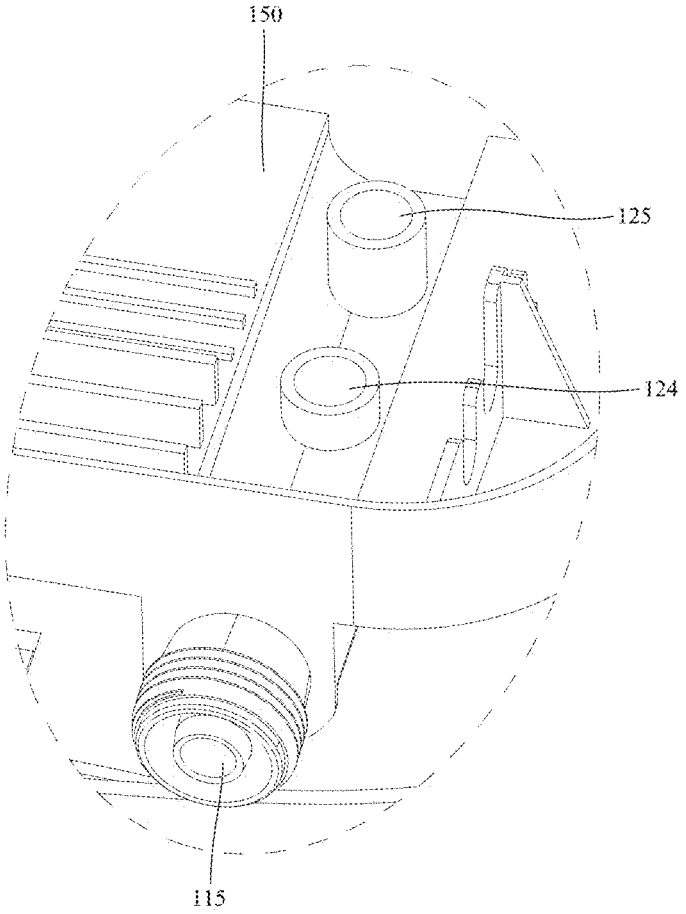
FIG. 22 is an enlarged view at portion L in FIG. 21.
Figure 23:
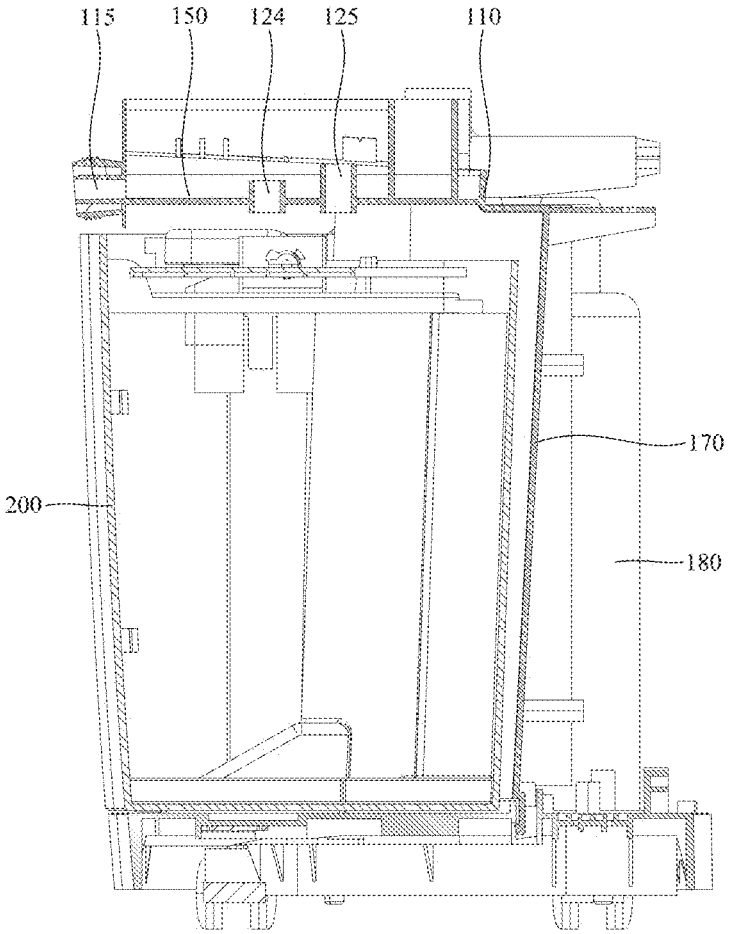
FIG. 23 is a schematic cross-sectional view of the water pan, the water tank and the partition in FIG. 21.
Figure 24:
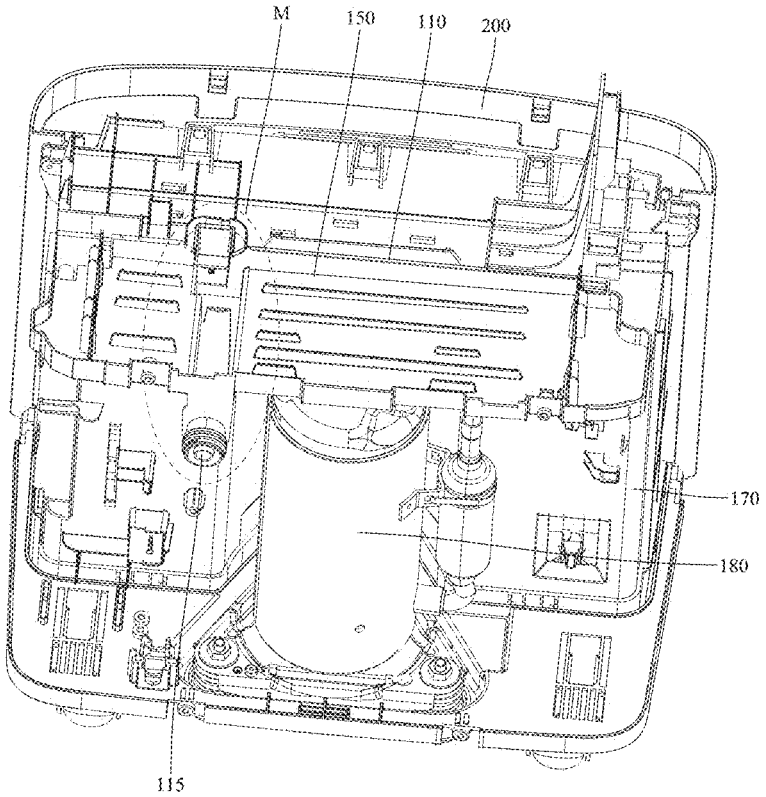
FIG. 24 is a schematic structural diagram of a water pan, a water tank and a partition of a humidifier according to some embodiments of the present disclosure.
Figure 25:
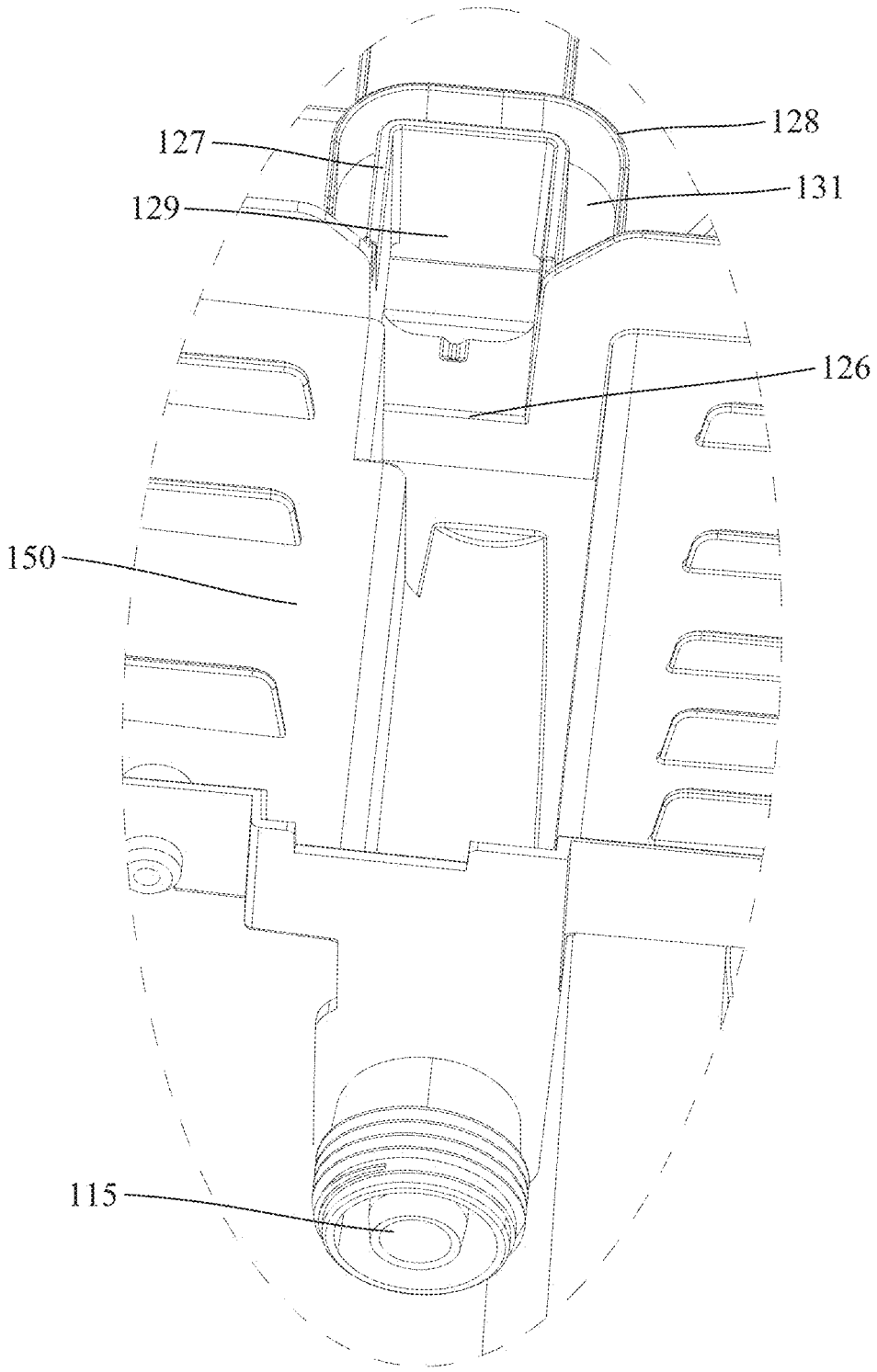
FIG. 25 is an enlarged view at portion M in FIG. 24.
Figure 26:
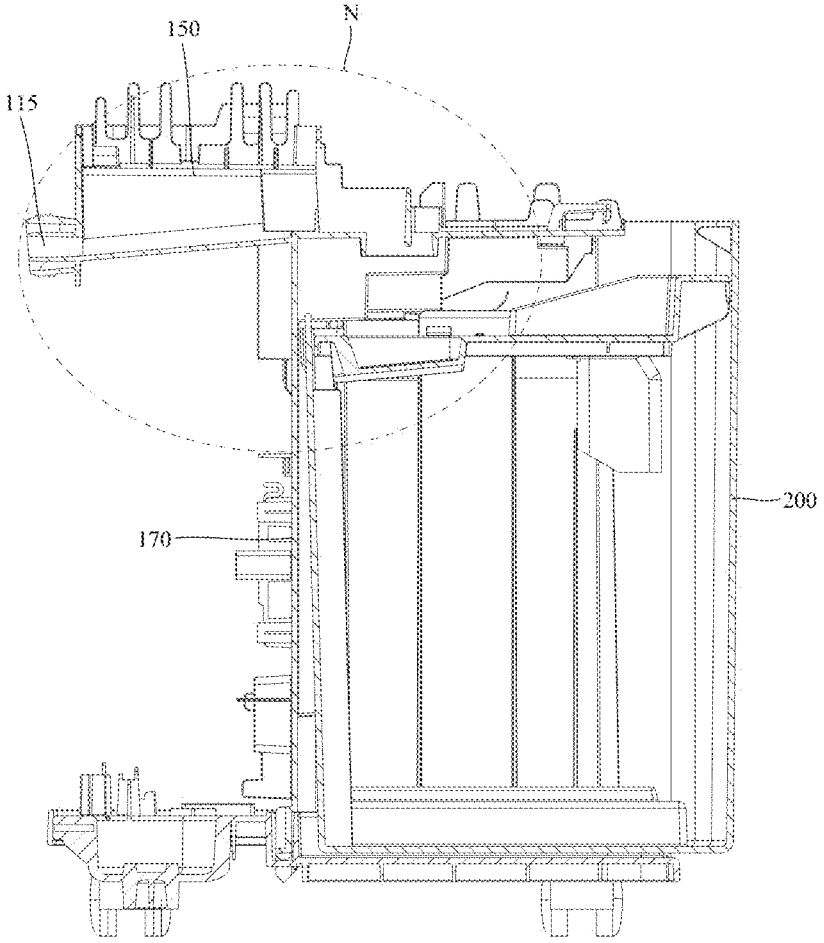
FIG. 26 is a schematic cross-sectional view of the water pan, the water tank and the partition in FIG. 24.
Figure 27:
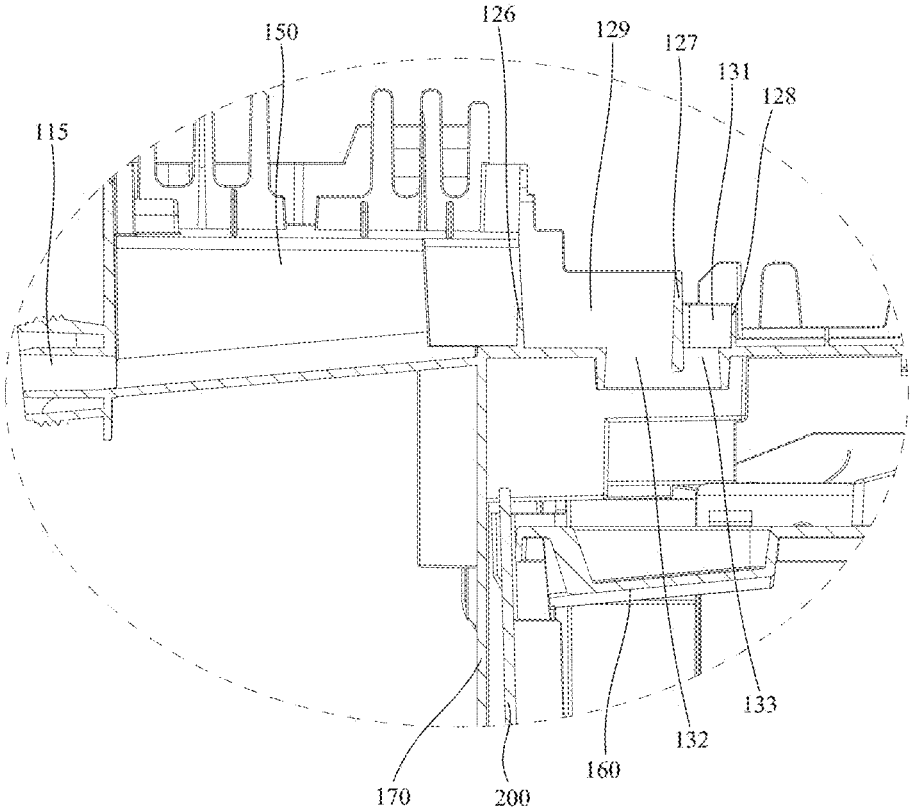
FIG. 27 is an enlarged view at portion N in FIG. 26.

There are a variety of dehumidifier structures. As shown in FIG. 7 and FIG. 8, in some embodiments, the body 100 has a working state and an idle state, the body 100 is provided at an upper end of the water tank 200 when in the working state, and the body 100 is at least partially received in the water tank 200 when in the idle state. The water tank 200 may receive the body 100. When the body 100 is working, the body 100 can be lifted partly outside the water tank 200, and the bottom of the body 100 is spaced apart from the bottom of the water tank 200, such that when the body 100 works, the generated water can be discharged into the water tank 200, and when the body 100 is in an idle state after finishing working, the body 100 can be put into the water tank 200 after the water in the water tank 200 is discharged. In some embodiments, when the body 100 is in a working state, the abutment protrusion 210 abuts against the unlock member 194. The body 100 may be cylindrical, elliptical cylindrical or prismatic, and the shape of the water tank 200 is adapted to the shape of the body 100. When the body 100 is in the shape of a prism, it may be in the shape of a square, a regular pentagon, or a regular hexagon, or the like.

Compared with the dehumidifier in which the water tank 200 is provided inside the body 100, in these embodiments, the volume of the water tank 200 is larger, the water storage capacity of the water tank 200 is increased, the frequency of pouring water by the user is reduced, and the weight of the body 100 is also reduced, which is convenient for the user to carry the body 100. Moreover, when the dehumidifier is in the idle state, by accommodating the body 100 in the water tank 200, the center of gravity of the dehumidifier can be lowered, such that the dehumidifier may stand relatively stable and be harder to fall over, and the overall occupied space of the dehumidifier is also reduced, which facilitates user's storage. In addition, when the dehumidifier is in the working state, the body 100 is at a higher position, which raises the height of the air outlet on the dehumidifier, such that the dehumidified air can be blown to a farther place, which is beneficial to improve the air flow range of indoor.

As shown in FIG. 4, FIG. 9 to FIG. 14, in some embodiments, the water collection mechanism increase a chassis 140 and a water pan 110 provided above the chassis 140. The chassis 140 is provided with the water groove 150 and the drainage passageway 160. The water pan 110 is provided with a water sink 111 communicated with the water groove 150. The dehumidification device is provided above the water pan 110. The water pan 110 is used to collect the dehumidification water produced by the dehumidification device. The dehumidification water can flow to the water sink 111, then flow to the water groove 150 through the water sink 111, and finally flows to the inner wall of the water tank 200 through the drainage passageway 160. Since the chassis 140 is provided below the water pan 110, when the dehumidifier is in the working state, the chassis 140 is closer to the water tank 200 than the water pan 110, that is to say, the water groove 150 on the chassis 140 is equivalent to a transfer structure of dehumidification water, which is more conducive to guiding the dehumidification water to the inner side wall of the water tank 200.

In some embodiments, the water sink 111 is provided with a first isolation rib 112 for dividing the water sink 111 into a first water sink 114 and a second water sink 116. The first isolation rib 112 is lower than a rim of the water sink 111. The water pan 110 is further provided with a guide rib 121 for guiding the water produced by the dehumidification device to the first water sink 114, the first water sink 114 is provided with a drainage outlet 115, the second water sink 116 is provided with a first drainage hole 117, and the first drainage hole 117 is communicated with the water groove 150.

In some embodiments, the guide rib 121 is at least partially provided at the edge of the second water sink 116 of the water sink 111, to prevent the dehumidification water from flowing to the second water sink 116 and guide the dehumidification water to flow to the first water sink 114. The drainage outlet 115 is used to communicate with the external pipe for drainage, that is to say, when the dehumidifier is drained, the drainage outlet 115 is prior. For example, when the user does not want or is inconvenient to receive water from the water tank 200, the drainage outlet 115 can be used for drainage. After sealing the drainage outlet 115 and the water in the first water sink 114 reaches the upper side of the first isolation rib 112, the dehumidification water in the first water sink 114 can overflow the first isolation rib 112 to the second water sink 116 and then be discharged to the water groove 150 through the first drainage hole 117. With such a configuration, it is convenient for the user to select the drainage mode in different using places. The drainage outlet 115 may only include a through hole structure penetrating through the first water sink 114, or may include a through hole penetrating through the first water sink 114 and a drainage joint connecting the through hole, and the like.

In some embodiments, a second isolation rib 113 is provided inside the water sink 111 for forming a third water sink 118, and the second isolation rib 113 is higher than the first isolation rib 112 and lower than the rim of the water sink 111. The third water sink 118 is provided with a second drainage hole 119, a drainage pipe communicated with the second drainage hole 119 is provided at a side of the water pan 110 facing the chassis 140, and the drainage pipe penetrates the chassis 140 to communicate with the water tank 200. In some embodiments, the second isolation rib 113 is provided in the second water sink 116 to separate out a third water sink 118, and the first drainage hole 117 and the second drainage hole 119 are separately provided on both sides of the second isolation rib 113. The chassis 140 is provided with a avoiding through hole, and the drainage pipe extends into the avoiding through hole to communicate with the water tank 200. Since the second isolation rib 113 is higher than the first isolation rib 112, the dehumidification water in the water sink 111 can cross the second isolation rib 113 and overflow to the third water sink 118 when the amount of water in the water sink 111 reaches the upper side of the second isolation rib 113. Sequentially, the dehumidification water can directly flow into the water tank 200 through the second drainage hole 119 and the drain pipe. With such a configuration, even if the first drainage hole 117 is blocked, the dehumidification water can flow to the water tank 200, thereby avoiding that the dehumidification water overflows from the water pan 110. The first isolation rib 112 and the second isolation rib 113 may be independent of each other, or may be connected to each other. In other embodiments, the second isolation rib 113 can also be provided in the first water sink 114, to separate out the third water sink 118, and the drainage outlet 115 and the second drainage hole 119 are respectively provided at two sides of the second isolation rib 113.

In some embodiments, the height difference between the first isolation rib 112 and the drainage outlet 115 is greater than or equal to 5 mm, that is to say, the height difference between the upper side of the first isolation rib 112 and the lowest point of the drainage outlet 115 in the up and down direction is greater than or equal to 5 mm, thereby avoiding the dehumidification water from overflowing the first isolation rib 112 and entering the second water sink 116 when draining through the drainage outlet 115. In some embodiments, the height difference between the first isolation rib 112 and the second isolation rib 113 is greater than or equal to 5 mm, that is to say, the height difference between the upper side of the first isolation rib 112 and the upper side of the second isolation rib 113 in the vertical direction is greater than or equal to 5 mm, thereby avoiding the dehumidification water from overflowing the second isolation rib 113 and entering the third water sink 118 when draining through the first drainage hole 117.

In addition, different from the above-mentioned embodiments in which the water sink 111 is divided into a first water sink 114 and a second water sink 116 by the first isolation rib 112, in another embodiments, as shown in FIG. 15 to FIG. 20, the water sink 111 is provided with a drainage outlet 115 and a first overflow pipe 122. The upper nozzle of the first overflow pipe 122 is higher than the drainage outlet 115 and lower than the rim of the water sink 111. The overflow pipe is communicated with the water groove 150. Since the upper nozzle of the first overflow pipe 122 is higher than the drainage outlet 115, the water in the water sink 111 will be discharged through the drainage outlet 115 preferentially, and after the drainage outlet 115 is sealed, when the water in the water sink 111 reaches the upper nozzle of the first overflow pipe 122, the dehumidification water in the water sink 111 can be discharged through the first overflow pipe 122 to the water groove 150. In this way, it is convenient for the user to select the drainage mode, which improves the application scenarios of the dehumidifier.

In some embodiments, the lower nozzle of the first overflow pipe 122 extends toward the water groove 150, such that the distance between the lower nozzle of the first overflow pipe 122 and the bottom wall of the water groove 150 is relatively small. Therefore, the dehumidification water can flow along the inner pipe wall of the first overflow pipe 122 toward the water groove 150, which can reduce the dripping noise generated when the dehumidification water drips from the water pan 110 to the water groove 150.

In some embodiments, a second overflow pipe 123 is also provided in the water sink 111, and the upper nozzle of the second overflow pipe 123 is higher than the upper nozzle of the first overflow pipe 122 and lower than the upper rim of the water sink 111. The lower end of the second overflow pipe 123 passes through the chassis 140 to communicate with the water tank 200. In some embodiments, the chassis 140 is provided with an avoiding through hole, and the lower end of the second overflow pipe 123 extends through the avoiding through hole to communicate with the water tank 200, such that the dehumidification water flowing down from the second overflow pipe 123 can directly flow into the water tank 200. Since the upper nozzle of the second overflow pipe 123 is higher than the upper nozzle of the first overflow pipe 122, when the water in the water sink 111 reaches the upper nozzle of the second overflow pipe 123, the dehumidification water in the water sink 111 can flow into the water tank 200 through the second overflow pipe 123. With such a configuration, even when the first overflow pipe 122 is blocked, the dehumidification water can flow to the water tank 200, thereby preventing the dehumidification water from overflowing from the water pan 110.

In some embodiments, the height difference between the first overflow pipe 122 and the drainage outlet 115 is greater than or equal to 5 mm, that is to say, the height difference between the upper nozzle of the first overflow pipe 122 and the lowest point of the drainage outlet 115 in the vertical direction is greater than or equal to 5 mm, thereby preventing the dehumidification water from flowing from the first overflow pipe 122 to the water groove 150 when the drainage outlet 115 is used for drainage. In some embodiments, the height difference between the first overflow pipe 122 and the second overflow pipe 123 is greater than or equal to 5 mm, that is to say, the height difference between the upper nozzle of the first overflow pipe 122 and the upper nozzle of the second overflow pipe 123 is greater than or equal to 5 mm in the vertical direction, thereby preventing the dehumidification water from flowing directly from the second overflow pipe 123 to the water tank 200 when the first overflow pipe 122 is used.

Different from the embodiments in which the body 100 may be received in the water tank 200, in some embodiments, the body 100 includes a partition 170 and a compressor 180 in other embodiments. The water tank 200 and the compressor 180 are respectively provided at two sides of the partition 170. The water collection mechanism includes a water pan 110 provided above the partition 170, the water pan 110 is provided with the water groove 150 above the water tank 200, and a side of the water groove 150 away from the partition 170 is provided with a drainage outlet 115 provided at a lowest position of the water groove 150. The water tank 200 is at least partly provided in the shell of the body 100. The water groove 150, and the drainage outlet 115 and the water tank 200 are all provided on the side of the partition 170 away from the compressor 180. The water groove 150 is provided above the water tank 200, and the dehumidification device is provided above the water groove 150. That is to say, the side where the compressor 180 is provided may be set as the front side of the dehumidifier, and the side where the water groove 150, the drainage outlet 115 and the water tank 200 are provided may be set as the back side of the dehumidifier. In this way, the user can select the drainage outlet 115 for drainage, and the stored dehumidification water can also be drained to the water tank 200, which facilitates the user to select the drainage mode and improves the applicable scene of the dehumidifier. Moreover, the water groove 150, the drainage outlet 115 and the water tank 200 may be provided at the back side of the dehumidifier, which can ensure the integrity of the front panel of the dehumidifier and improve the appearance effect. The drainage passageway 160 can be provided on the water pan 110, or can be provided on the water tank 200.

In some embodiments, the groove bottom wall of water groove 150 is provided with a third overflow pipe 124 and a fourth overflow pipe 125, and both the third overflow pipe 124 and the fourth overflow pipe 125 are communicated with water tank 200. The upper nozzle of the third overflow pipe 124 is higher than the drainage outlet 115 and lower than the upper nozzle of the fourth overflow pipe 125. Since the upper nozzle of the third overflow pipe 124 is higher than the drainage outlet 115, the water in the water groove 150 will be discharged from the drainage outlet 115 preferentially. If the drainage outlet 115 is sealed, when the water in the water groove 150 reaches the upper nozzle of the third overflow pipe 124, the dehumidification water in the water groove 150 can be discharged from the third overflow pipe 124 to the water tank 200. When the third overflow pipe 124 is blocked, it can also ensure that the dehumidification water is discharged from the fourth overflow pipe 125 to the water tank 200, which can reduce the possibility of the dehumidification water overflowing from the water pan 110. In other embodiments, only the third overflow pipe 124 may be provided.

In some embodiments, the height difference between the third overflow pipe 124 and the drainage outlet 115 is greater than or equal to 5 mm, that is to say, the height difference between the upper nozzle of the third overflow pipe 124 and the lowest point of the drainage outlet 115 in the vertical direction is greater than or equal to 5 mm, to avoid dehumidification water flowing from the third overflow pipe 124 to the water tank 200 when the drainage outlet 115 is used for drainage. In some embodiments, the height difference between the third overflow pipe 124 and the fourth overflow pipe 125 is greater than or equal to 5 mm, that is to say, the height difference between the upper nozzle of the third overflow pipe 124 and the upper nozzle of the fourth overflow pipe 125 is greater than or equal to 5 mm in the vertical direction, to avoid dehumidification water flowing from the fourth overflow pipe 125 to the water tank 200 when the third overflow pipe 124 is used for drainage.

In addition, different from the embodiments in which the water pan 110 is provided with the water groove 150 above the water tank 200, in some embodiments, the body 100 includes a partition 170 and a compressor 180, and the water tank 200 and the compressor 180 are respectively provided at two sides of the partition 170. The water collection mechanism includes a water pan 110 provided above the partition 170, the water pan 110 is provided with the water groove 150 above the compressor 180, and a side of the water groove 150 away from the partition 170 is provided with a drainage outlet 115 provided at a lowest position of the water groove 150. The water tank 200 is at least partly provided in the shell of the body 100. The water groove 150, and the drainage outlet 115 and the compressor 180 are all provided on the side of the partition 170 away from the water tank 200. The water groove 150 is provided above the compressor 180, and the dehumidification device is provided above the water groove 150. That is to say, the side where the water tank 200 is provided may be set as the front side of the dehumidifier, and the side where the water groove 150, the drainage outlet 115 and the compressor 180 are provided may be set as the back side of the dehumidifier. In this way, the user can select the drainage outlet 115 for drainage, and the stored dehumidification water can also be drained to the water tank 200, which facilitates the user to select the drainage mode and improves the applicable scene of the dehumidifier. Moreover, the drainage outlet 115 may be provided at the back side of the dehumidifier, which can ensure the integrity of the front panel of the dehumidifier and improve the appearance effect.

In some embodiments, the water pan 110 is provided with a first overflow groove 129 above the water tank 200, and an overflow rib 126 is provided between the first overflow groove 129 and the water groove 150. The overflow rib 126 is higher than the drainage outlet 115, and lower than the rim of the first overflow groove 129. The bottom wall of the first overflow groove 129 is provided with a first through hole 132, and the first through hole 132 is communicated with the water tank 200. In some embodiments, the overflow rib 126 is a partition 170 wall between the first overflow groove 129 and the water groove 150, the upper edge of the overflow rib 126 is higher than the drainage outlet 115, and lower than the upper rim of the water pan 110. After sealing the drainage outlet 115, the dehumidification water in the water pan 110 can flow from the overflow rib 126 to the first overflow groove 129, and flow from the first through hole 132 in the first overflow groove 129 to water tank 200. That is to say, the user can choose to use or not use the drainage outlet 115 according to the drainage mode, which improves the dehumidifier applicability of different scenarios.

In some embodiments, the water pan 110 is provided with a first water baffle 127 above the water tank 200 and a second water baffle 128 provided at intervals on the outer periphery of the first water baffle 127. The first water baffle 127 is enclosed with the side wall of the water groove 150 to form the first overflow groove 129. The upper end of the first water baffle 127 is higher than the overflow rib 126. The second water baffle 128 is enclosed with the first water baffle 127 to form the second overflow groove 131, and the second overflow groove 131 is provided with a second through hole 133. The second through hole 133 is communicated with the water tank 200. In some embodiments, both ends of the first water baffle 127 are connected to the side wall of the water groove 150, and the upper edge of the first water baffle 127 is lower than the upper rim of the water pan 110. Both ends of the second water baffle 128 are also connected to the side wall of the water groove 150, such that the second water baffle 128, the first water baffle 127 and the side wall of the water groove 150 are jointly enclosed to form a second overflow groove 131. In this way, after the drainage outlet 115 is sealed, the dehumidification water in the water pan 110 firstly flows to the first overflow groove 129, and then flows to the water tank 200 through the first through hole 132. Even if the first through hole 132 is blocked, the dehumidification water in the first overflow groove 129 will overflow to the second overflow groove 131, which can prevent the dehumidification water overflowing from the water pan 110. In other embodiments, the second water baffle 128 and the first water baffle 127 may also be connected, and the first water baffle 127 is provided with an overflow port that is communicated with the second overflow groove 131.

In some embodiments, the height difference between the overflow rib 126 and the drainage outlet 115 is greater than or equal to 5 mm, that is to say, the height difference between the upper edge of the overflow rib 126 and the lowest point of the drainage outlet 115 in the vertical direction is greater than or equal to 5 mm, thereby preventing the dehumidification water from overflowing the overflow rib 126 and flowing to the water tank 200 when draining by the drainage outlet 115. In some embodiments, the height difference between the overflow rib 126 and the rim of the first overflow groove 129 (the upper edge of the first water baffle 127) is greater than or equal to 5 mm, that is to say, the height difference between the upper edge of the overflow rib 126 and the rim of the overflow groove in the vertical direction is greater than or equal to 5 mm, thereby preventing the dehumidification water from overflowing the rim of the first overflow groove 129 when draining through the first through hole 132.

In some embodiments, the water tank 200 is provided with a drainage passageway 160, and the drainage passageway 160 is provided below the first through hole 132 and the second through hole 133. In some embodiments, the water tank 200 is provided with a water drainage groove, one end of the water drainage groove extends toward the inner wall of the water tank 200, and a drainage passageway 160 is formed on the drainage groove. The rim of the drainage groove is provided below the first through hole 132 and the second through hole 133, such that the drainage groove can receive the dehumidification water flowing down from the first through hole 132 and the second through hole 133, and guide the dehumidification water to the inner side wall of the water tank 200, thereby preventing the dehumidification water from dripping through the first through hole 132 and the second through hole 133 to the water tank 200, which may reduce the dripping noise.

The above are only some embodiments of the present disclosure, and do not limit the scope of the present disclosure thereto. Under the concept of the present disclosure, equivalent structural transformations made according to the description and drawings of the present disclosure, or direct/indirect disclosure in other related technical fields are included in the scope of the present disclosure.

What is claimed is:

1. A dehumidifier comprising:
a water tank;
a body including a dehumidification device and a plug mechanism; and
a water collection mechanism below the dehumidification device and between the body and the water tank, the water collection mechanism including:
a water groove; and
a drainage passageway communicated with the water groove and configured to guide water produced by the dehumidification device to an inner wall of the water tank;
wherein:
the plug mechanism includes:
a plug member in a pivot joint with the water groove and including an unlock member; and
an elastic member configured to press the plug member to the water hole for plugging the water hole;
the water tank includes an abutment protrusion configured to, when the water tank is assembled with the body, abut against the unlock member to raise the plug member for opening the water hole;
a fixation column is provided on a bottom of the water groove, and a free end of the fixation column is provided with a limit member;
the plug member is provided with an avoidance hole, and the fixation column passes through the avoidance hole;
the elastic member is sleeved at the fixation column; and
one end of the elastic member is in abutment with a side of the plug member away from the water hole, and another end of the elastic member is in abutment with the limit member.

2. The dehumidifier of claim 1, wherein the drainage passageway includes:
a water hole penetrating the bottom of the water groove; and
a guide groove provided under and communicated with the water hole, an outlet of the guide groove facing the inner wall of the water tank.

3. The dehumidifier of claim 2, wherein the plug mechanism is movably mounted on the water groove to open or close the water hole.

4. The dehumidifier of claim 2, wherein:
the inner wall of the water tank is provided with a support member; and
the outlet of the guide groove is provided above the support member.

5. The dehumidifier of claim 4, wherein the outlet of the guide groove is provided with a guide notch, and the guide notch is located at a lower wall of the guide groove.

6. The dehumidifier of claim 1, wherein an avoidance notch is provided on a side wall of the water groove, and the unlock member protrudes through the avoidance notch.

7. The dehumidifier of claim 1, wherein the plug member includes:
a pressure plate in pivot joint with the water groove, the unlock member being provided on the pressure plate; and
a water plug provided on the pressure plate for opening or closing the water hole.

8. The dehumidifier of claim 1, wherein a line from the water hole to the fixation column is parallel to a pivot shaft of the plug member.

9. The dehumidifier of claim 1, wherein the body is configured to be:
provided at an upper end of the water tank when the body is in a working state, and
at least partially received in the water tank when the body is in the idle state.

10. The dehumidifier of claim 1, wherein the water collection mechanism further includes:
a chassis provided with the water groove and the drainage passageway; and
a water pan provided above the chassis, the water pan being provided with a water sink communicated with the water groove.

11. The dehumidifier of claim 10, wherein:
the water sink is provided with an isolation rib dividing the water sink into a first water sink and a second water sink;
the isolation rib is lower than a rim of the water sink;
the water pan is further provided with a guide rib configured to guide the water produced by the dehumidification device to the first water sink;
the first water sink is provided with a drainage outlet; and
the second water sink is provided with a drainage hole communicated with the water groove.

12. The dehumidifier of claim 10, wherein:
the water sink is provided with a first isolation rib and a second isolation rib inside the water sink, the first isolation rib and the second isolation rib dividing the water sink into a first water sink, a second water sink, and a third water sink;
the first isolation rib is located between the first water sink and the second water sink, and is lower than a rim of the water sink;
the second isolation rib includes a first part located between the first water sink and the third water sink, and a second part located between the second water sink and the third water sink;
the first water sink is provided with a drainage outlet;
the second water sink is provided with a first drainage hole communicated with the water groove;
the water pan is further provided with a guide rib configured to guide the water produced by the dehumidification device to the first water sink;
the second isolation rib is higher than the first isolation rib and lower than the rim of the water sink;
the third water sink is provided with a second drainage hole;

a drainage pipe communicated with the second drainage hole is provided at a side of the water pan facing the chassis; and the drainage pipe penetrates the chassis to communicate with the water tank.

13. The dehumidifier of claim 1, wherein:

the body includes a partition and a compressor;

the water tank and the compressor are provided at two sides of the partition, respectively;

the water collection mechanism includes a water pan provided above the partition;

the water pan is provided with the water groove above the water tank; and a side of the water groove away from the partition is provided with a drainage outlet, and the drainage outlet is provided at a lowest position of the water groove.

14. The dehumidifier of claim 1, wherein:

the body includes a partition and a compressor;

the water tank and the compressor are provided at two sides of the partition, respectively;

the water collection mechanism includes a water pan provided above the partition;

the water pan is provided with the water groove above the compressor; and a side of the water groove away from the partition is provided with a drainage outlet, and the drainage outlet is provided at a lowest position of the water groove.

15. A dehumidifier comprising:

a water tank;

a body including a dehumidification device; and a water collection mechanism below the dehumidification device and between the body and the water tank, the water collection mechanism including:

a water groove;

a drainage passageway communicated with the water groove and configured to guide water produced by the dehumidification device to an inner wall of the water tank;

a chassis provided with the water groove and the drainage passageway; and a water pan provided above the chassis, the water pan being provided with a water sink communicated with the water groove;

wherein:

the water sink is provided with a first isolation rib and a second isolation rib inside the water sink, the first isolation rib and the second isolation rib dividing the water sink into a first water sink, a second water sink, and a third water sink;

the first isolation rib is located between the first water sink and the second water sink, and is lower than a rim of the water sink;

the second isolation rib includes a first part located between the first water sink and the third water sink, and a second part located between the second water sink and the third water sink;

the first water sink is provided with a drainage outlet;

the second water sink is provided with a first drainage hole communicated with the water groove;

the water pan is further provided with a guide rib configured to guide the water produced by the dehumidification device to the first water sink;

the second isolation rib is higher than the first isolation rib and lower than the rim of the water sink;

the third water sink is provided with a second drainage hole;

a drainage pipe communicated with the second drainage hole is provided at a side of the water pan facing the chassis; and the drainage pipe penetrates the chassis to communicate with the water tank.

* * * * *